US006213095B1

(12) United States Patent
Asada et al.

(10) Patent No.: US 6,213,095 B1
(45) Date of Patent: Apr. 10, 2001

(54) COMMON RAIL AND METHOD OF MANUFACTURING THE SAME

(75) Inventors: Kikuo Asada, Mishima; Masayoshi Usui, Numazu; Eiji Watanabe, Shizuoka; Kazunori Takikawa, Numazu, all of (JP)

(73) Assignee: Usui Kokusai Sangyo Kaisha Limited (JP)

( * ) Notice: Subject to any disclaimer, the term of this patent is extended or adjusted under 35 U.S.C. 154(b) by 0 days.

(21) Appl. No.: 09/033,816

(22) Filed: Mar. 3, 1998

(30) Foreign Application Priority Data

Mar. 3, 1997 (JP) ..... 9-063843
Mar. 3, 1997 (JP) ..... 9-063846

(51) Int. Cl.[7] ..... F02M 41/00; F02M 55/02
(52) U.S. Cl. ..... 123/456; 123/468
(58) Field of Search ..... 123/456, 447, 123/468, 469; 285/332.2, 334.1, 333.1, 125.1, 133.11

(56) References Cited

U.S. PATENT DOCUMENTS 4,286,563 * 9/1981 Fahim et al. ..... 123/469
4,586,733 * 5/1986 Anderson, Jr. ..... 285/12
4,893,601 * 1/1990 Sugao ..... 123/468
4,900,180 * 2/1990 Takikawa ..... 403/233
5,120,084 * 6/1992 Hashimoto ..... 285/156
5,169,182 * 12/1992 Hashimoto ..... 285/332.2

* cited by examiner

*Primary Examiner*—Noah P. Kamen
*Assistant Examiner*—Mahmoud Gimie
(74) *Attorney, Agent, or Firm*—Anthony J. Casella; Gerald E. Hespos; Michael J. Porco

(57) ABSTRACT

A common rail is provided for promoting inner pressure fatigue strength at location in proximity to a branch pipe. The common rail includes a main pipe rail with a main flow path. At least one boss in provided on the peripheral wall and includes a branch hole communicating the main flow path. The branch pipe is provided with a connecting head that has a pressing face at and end of the branch pipe. The pressing face of the branch pipe is urged into a pressure receiving seat of the boss. A compressive residual stress is provided at location in the peripheral wall where the main flow path of the main pipe rail communicates with the branch hole. The compressive residual stress increases the pressure fatigue strength by substantially canceling tensile stress.

4 Claims, 21 Drawing Sheets

COMMON RAIL AND METHOD OF MANUFACTURING THE SAME

BACKGROUND OF THE INVENTION

1. Field of the Invention

The present invention relates to a common rail such as a high pressure fuel manifold in an accumulator fuel injection system of a diesel internal combustion engine, a block rail or the like.

2. Description of the Prior Arts

Conventionally, there have been known common rails of this kind, for example, as illustrated by FIGS. 21 and 22. The common rail shown by FIG. 21 is of a system constituted by perforating branch holes 21-2 each having a pressure receiving seat face 21-4 communicating with a flow path 21-1 of a main pipe rail 21 and opened outwardly at a plurality of boss portions 21-3 provided at intervals at a peripheral wall portion in the axial direction on the side of the main pipe rail 21 comprising a circular pipe, engageably bring pressing seat faces 22-3 constituted by connection head portions 22-2 on the side of branch pipes 22 into contact with the pressure receiving seat faces 21-4 on the side of the main pipe rail 21 and screwing fastening box nuts 23 previously integrated to the side of the branch pipes via washers 24 to male screws (outside screws) 21-5 provided on outer peripheral faces of the boss portions 21-3 to thereby fixedly fastening the branch pipes to the main pipe rail by pressing action at the connection head portions 22-2. In FIG. 21, notation 22-1 designates a flow path of the branch pipe 22.

Further, a common rail shown by FIG. 22 is of a system constituted by machining bottomed holes to a plurality of boss portions 21-3 provided at intervals at a peripheral wall portion in the axial direction on the side of a main pipe rail 21 similar to FIG. 21, providing female screws (inside screws) 21-6 on inner peripheral faces of the bottomed holes and screwing fastening male nuts 25 to the female crews (inside screws) 21-6 to thereby fastening branch pipes to the main pipe rail 21 by pressing action at the connection head portions 22-2. Incidentally, in FIG. 22, numeral 26 designates a sleeve washer.

However, in the case of a common rail having a structure where the branch hole 21-2 is installed to the boss portion 21-3 provided to the main pipe rail 21 comprising a circular pipe, large tensile stress is caused at an opening end portion P at the flow path of the main pipe rail in the branch hole 21-2 by high inner pressure of the main pipe rail 21 and cracks are liable to cause with the opening end portion P as onset which may give rise to leakage.

SUMMARY OF THE INVENTION

The present invention has been carried out in order to resolve the above-described conventional problem and it is an object of the present invention to provide a common rail and its fabrication method capable of promoting the inner pressure fatigue strength by decreasing a value of a maximum tensile stress generated at an inner peripheral edge portion of a lower end of a branch hole.

In order to achieve the above-described object, according to a first aspect of the present invention, there is provided a common rail comprising a main pipe rail comprising a flow path at inside of the main pipe rail in a direction of an axis center, and at least one boss portion provided to a peripheral wall portion in an axial direction of the main pipe rail, said boss portion including a branch hole communicated with the flow path and having a pressure receiving seat face opened outwardly, a branch pipe having a flow path communicating with the flow path, said branch pipe including a pressing seat face portion constituted by a connection head portion installed at an end portion of the branch pipe, wherein the pressing seat face portion of the branch pipe is engageably brought into contact with the pressure receiving seat face of the main pipe rail and the branch pipe is connected to the main pipe rail by fastening to screw a fastening nut previously integrated to a side of the branch pipe to the boss portion to thereby press the main pipe rail right under the connection head portion, and wherein a compressive residual stress is made to exist at a periphery of an opening end portion of the flow path of the main pipe rail at the branch hole.

According to a second aspect of the present invention, there is provided a method of fabricating a common rail, the common rail comprising a main pipe rail comprising a flow path at inside of the main pipe rail in a direction of an axis center, and at least one boss portion provided to a peripheral wall portion in an axial direction of the main pipe rail, said boss portion including a branch hole communicated with the flow path and having a pressure receiving seat face opened outwardly, a branch pipe having a flow path communicating with the flow path, said branch pipe including a pressing seat face portion constituted by a connection head portion installed at an end portion of the branch pipe, wherein the pressing seat face portion of the branch pipe is engageably brought into contact with the pressure receiving seat face of the main pipe rail and the branch pipe is connected to the main pipe rail by fastening to screw a fastening nut previously integrated to a side of the branch pipe to the boss portion to thereby press the main pipe rail right under the connection head portion, and wherein a compressive residual stress is generated at a periphery of an opening end portion of the flow path of the main pipe rail at the branch hole by applying a pressing force in a direction of an axis of the boss portion from outside preferably by a press system. It is preferable to apply the pressing force in the axial direction of the boss portion from outside by an outside pressing system and at the same time the branch hole is punched through.

Further, according to a third aspect of the present invention, there is provided a method of fabricating a common rail, the common rail comprising a main pipe rail comprising a flow path at inside of the main pipe rail in a direction of an axis center, and at least one boss portion provided to a peripheral wall portion in an axial direction of the main pipe rail, the boss portion including a branch hole communicated with the flow path and having a pressure receiving seat face opened outwardly, a branch pipe having a flow path communicating with the flow path, said branch pipe including a pressing seat face portion constituted by a connection head portion installed at an end portion of the branch pipe, wherein the pressing seat face portion of the branch pipe is engageably brought into contact with the pressure receiving seat face of the main pipe rail and the branch pipe is connected to the main pipe rail by fastening to screw a fastening nut previously integrated to a side of the branch pipe to the boss portion to thereby press the main pipe rail right under the connection head portion, and wherein a compressive residual stress is generated at a periphery of an opening end portion of the flow path of the main pipe rail at the branch hole by applying a pressing force on an inner peripheral face of the main pipe rail at a vicinity of the branch hole by an inside pressing system.

Further, according to a fourth aspect of the present invention, there is provided a method of fabricating a common rail, the common rail comprising a main pipe rail comprising a flow path at inside of the main pipe rail in a direction of an axis center, and at least one boss portion provided to a peripheral wall portion in an axial direction of the main pipe rail, said boss portion including a branch hole communicated with the flow path and having a pressure receiving seat face opened outwardly, a branch pipe having a flow path communicating with the flow path, said branch pipe including a pressing seat face portion constituted by a connection head portion installed at an end portion of the branch pipe, wherein the pressing seat face portion of the branch pipe is engageably brought into contact with the pressure receiving seat face of the main pipe rail and the branch pipe is connected to the main pipe rail by fastening to screw a fastening nut previously integrated to a side of the branch pipe to the boss portion to thereby press the main pipe rail right under the connection head portion, and wherein a compressive residual stress is generated at a periphery of an opening end portion of the flow path of the main pipe rail at the branch hole by applying a pressing force by a pipe expanding system applying a pressure from an inside of the main pipe rail in a direction of a pipe diameter on an inner peripheral face of the main pipe rail at a vicinity of the branch hole.

Further, according to a fifth aspect of the present invention, there is provided a method of fabricating a common rail, the common rail comprising a main pipe rail comprising a flow path at inside of the main pipe rail in a direction of an axis center, and at least one boss portion provided to a peripheral wall portion in an axial direction of the main pipe rail, said boss portion including a branch hole communicated with the flow path and having a pressure receiving seat face opened outwardly, a branch pipe having a flow path communicating with the flow path, said branch pipe including a pressing seat face portion constituted by a connection head portion installed at an end portion of the branch pipe, wherein the pressing seat face portion of the branch pipe is engageably brought into contact with the pressure receiving seat face of the main pipe rail and the branch pipe is connected to the main pipe rail by fastening to screw a fastening nut previously integrated to a side of the branch pipe to the boss portion to thereby press the main pipe rail right under the connection head portion, and wherein a compressive residual stress is generated at a periphery of an opening end portion of the flow path of the main pipe rail at the branch hole by applying a pressing force by a diameter expanding system for applying a pressure in a direction of a diameter of the branch hole from an inside of the branch hole to an inner peripheral face of branch hole.

Further, according to a sixth aspect of the present invention, there is provided a method of fabricating a common rail, the common rail comprising a main pipe rail comprising a flow path at inside of the main pipe rail in a direction of an axis center, and at least one boss portion provided to a peripheral wall portion in an axial direction of the main pipe rail, said boss portion including a branch hole communicated with the flow path and having a pressure receiving seat face opened outwardly, a branch pipe having a flow path communicating with the flow path, said branch pipe including a pressing seat face portion constituted by a connection head portion installed at an end portion of the branch pipe, wherein the pressing seat face portion of the branch pipe is engageably brought into contact with the pressure receiving seat face of the main pipe rail and the branch pipe is connected to the main pipe rail by fastening to screw a fastening nut previously integrated to a side of the branch pipe to the boss portion to thereby press the main pipe rail right under the connection head portion, and wherein a compressive residual stress is generated at a periphery of an opening end portion of the flow path of the main pipe rail at the branch hole by pressing a spherical body or a slug having a converging front end to the opening end portion of the flow path of the main pipe rail at the branch hole.

That is, according to the present invention by making exist the compressive residual stress at the periphery of the opening end portion of the flow path of the main pipe rail at the branch hole of the boss portion inscribed with the outer screw or the inner screw, the value of the maximum tensile stress generated at the inner peripheral edge portion of the lower end of the branch hole is reduced by canceling the tensile stress generated at the inner peripheral edge portion P of the lower end of the branch hole caused by high inner pressure of the main pipe rail by the compressive residual stress. As a method of generating and making remain the compressive residual stress at the periphery of the opening end portion of the flow path of the main pipe rail at the branch hole, the invention is featured in using a method of applying the pressing force in the axial direction of the boss portion from outside by a press system or the like, or a system of applying pressure in the flow path of the main pipe rail, a pipe expanding system for applying a pressure in the direction of the pipe diameter from inside of the main pipe rail, a diameter expanding system for applying pressure in the diameter direction of the branch hole from inside of the branch hole, a system of pressing a spherical body or a slug having a converging front end to the opening end portion of the flow path of the main pipe rail at the branch hole.

In this case, as the method of applying the pressing force in the axial direction of the boss portion from outside by a press system or the like, a method of pressing or simultaneously pressing and punching through the branch hole by using a punch or a rod can be used in a state where, for example, the rail main body is fixed to a lower die.

Further, as the system of applying pressure to inside of the flow path of the main piper rail, liquid pressure such as oil hydraulic pressure or hydraulic pressure or the like can be used.

New, as the pipe expanding system for applying pressure in the direction of the pipe diameter from the inside of the rail, a method of pressing a diameter expanding member such as a spherical body having a diameter slightly larger than the inner diameter of the rail, a bullet type plug or the like into the flow path of the main pipe rail by a drawing system or a pushing system, a diameter expanding system by a burnishing tool or the like can be used.

Further, as the diameter expanding system for applying pressure in the diameter direction of the branch hole from inside of the branch hole, a method in which the branch hole is perforated with a diameter slightly smaller than a predetermined hole diameter and a spherical body or a plug having a diameter substantially the same as the inner diameter of the branch hole having the predetermined hole diameter is pressed into the branch hole having a small diameter by a pressing system, can be used.

Further, as the system of pressing a spherical body or a slug having a converging front end to the opening end portion of the flow path of the main pipe rail at the branch hole, there can be used a method in which a spherical body or a slug having a front end in a converging shape of a cone, an elliptical cone, or an oval cone is used, for example, a steel ball and a steel ball receiver or a slug having a converging front end and a slug receiver are inserted into the main pipe rail, the steel ball receiver or the slug receiver is arranged such that the spherical face of the steel ball or the conical face at the front end of the slug is brought into contact with the opening end portion of the flow path of the main pipe rail at the branch hole and a punch having a front end in a wedge shape is inserted and pushed in from other end portion of the main pipe rail thereby pressing the spherical face of the steel ball or the conical face of the front end of the slug to the opening end portion of the flow path of the main pipe rail at the branch hole.

As described above, according to the present invention, by making exist the compressive residual stress at the periphery of the opening end portion of the flow path of the main pipe rail at the branch hole, occurrence of tensile stress at the inner peripheral edge portion P of the lower end of the branch hole can be effectively restrained by canceling the tensile stress by the compressive residual stress in accumulating high pressure fuel into the flow path in using it and the inner pressure fatigue strength at the branch connecting portion can be promoted.

BRIEF DESCRIPTION OF THE DRAWINGS

FIG. 3(A), 3(B), 3(C), 3(D) and 3(E) exemplify pressing force applying means in the above-described fabrication method in which FIG. 3(A) is a partially-cut longitudinal sectional view of a boss portion showing a system of pressing by using a punch having a pressing face formed in an inverse recess shape, FIG. 3(B) is a longitudinal sectional view of a boss portion showing a system of pressing by a punch having a flat pressing face in which an annular projection is provided at an inner bottom portion of the boss portion, FIG. 3(C) is a longitudinal sectional view of a boss portion showing a system of pressing by using a punch having a spherical pressing face in which an inner bottom portion of the boss portion is formed in a recess shape, FIG. 3(D) is a longitudinal sectional view of a boss portion showing a system of pressing by using a punch having a flat pressing face in which an inner bottom portion of the boss portion is projected in a shape of a mountain and FIG. 3(E) is a longitudinal sectional view of a boss portion showing a system of pressing in which a bottomed hole having a diameter substantially the same as that of a branch hole is provided at the center of an inner bottom portion of the boss portion and a punch having a projection with a diameter insertible into the bottomed hole at a pressing face thereof is used;

FIGS. 7(A), 7(B), 7(C), 7(D) and 7(E) are views in correspondence with FIGS. 3(A), 3(B), 3(C), 3(D) and 3(E) explaining the pressing force applying means according to the first embodiment of the method of fabricating a common rail having boss portions of an outside screw type;

FIGS. 17(A) and 17(B) exemplify a fifth embodiment of a method of fabricating common rails having boss portions of an inside screw type according to the present invention in which FIG. 17(A) is a longitudinal sectional view of a boss portion showing a system of pressing an opening end portion at a flow path of a main pipe rail in a branch hole by using a spherical body and FIG. 17(B) is a longitudinal sectional view of a boss portion showing a system of pressing an opening end portion at a flow path of a main pipe rail in a branch hole by using a slug member having a conical front end;

FIGS. 18(A), 18(B), 18(C) and 18(D) are explanatory views showing a modified example of the fifth embodiment according to the present invention in which FIG. 18(A) is a longitudinal sectional view of the fifth embodiment, FIG. 18(B) is a sectional view taken from a line b—b of FIG. 18(A), FIG. 18(C) is a sectional view taken from a line c—c of FIG. 18(A) and FIG. 18(D) is a sectional view taken from a line d—d of FIG. 18(A);

DETAILED DESCRIPTION OF PREFERRED EMBODIMENT

Figure 1:
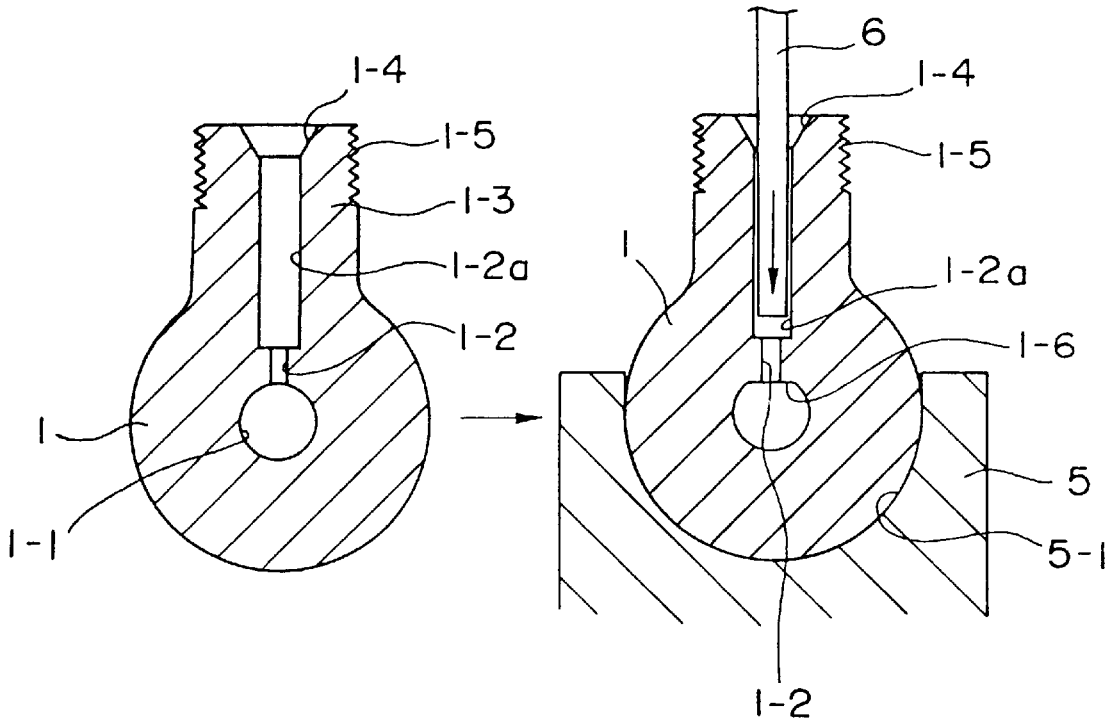
FIG. 1 is an outline view showing a first embodiment of a method of fabricating a common rail having boss portions of an outside screw type integrated with a main pipe rail according to the present invention.

In FIG. 1 through FIG. 20, numeral 1 designates a main pipe rail, numeral 2 designates a branch pipe, numeral 3 designates a fastening box nut, numeral 3' designates a fastening nut (male nut), numeral 4 designates a sleeve washer, numeral 5 designates a lower die, numeral 6 designates a punch, numerals 7-1 and 7-2 designate diameter expanding pieces, numeral 8 designates a fixing jig, numeral 9 designates a pulling device, numeral 10 designates a pressing device, numeral 11 designates a punch, numeral 12 designates a steel ball receiver and numeral 12' designates a slug receiver.

Explaining firstly a common rail having boss portions of an outside screw (male screw) type in reference to FIG. 1 through FIG. 5, a main pipe rail 1 of a common rail is a forged product of a material S45C or the like having a comparatively thick wall tubular portion with, for example, a diameter of 28 mm and a wall thickness of 9 mm in which an inner portion along an axis center constitutes a flow path 1-1 by mechanical working of boring or gun drilling or the like and a plurality of boss portions 1-3 are installed at the peripheral wall portion in the axial direction at intervals.

According to a method shown by FIG. 1, a branch hole 1-2 having a predetermined diameter and communicating with the flow path 1-1 of the main pipe rail 1 and a branch hole 1-2*a* having a large diameter communicating with the branch hole 1-2 are perforated at each of boss portions 1-3 integrated with the main pipe rail 1, a pressure receiving seat face 1-4 in a circular shape opened outwardly is formed at an outside opening end portion of the branch hole 1-2*a* and an outside screw 1-5 is fabricated on the outer periphery of the boss portion 1-3. Incidentally, the branch holes are constituted by a small diameter hole and a large diameter hole to be able to apply a pressing force to a peripheral portion of the branch hole 1-2 having the predetermined diameter by a punch or a rod.

Next, the vicinities of the boss portions 1-3 of the main pipe rail 1 are fixed by the lower die 5. As illustrated, the lower die 5 comprises a metal die with a section in a recess shape having a curved face 5-1 with a radius of curvature substantially the same as that of an outer peripheral face of the main pipe rail 1 and the main pipe rail 1 is fixed to the lower die 5 such that substantially the lower half of the outer periphery of the main pipe rail 1 can be constrained. This is for sufficiently providing the effect of pressing.

When the main pipe rail 1 is fixed to the lower die 5, a pressing force is applied on the bottom portion of the branch hole 1-2*a* by the punch 6 attached to the branch hole 1-2*a* having a large diameter and having a diameter a little smaller than the inner diameter of the branch hole by a press device (omitted in the drawing). The pressing force in this case may be at a degree of forming a flat portion 1-6 by slightly projecting the inner peripheral face of the flow path 1-1 of the main pipe rail at the vicinity of the branch hole 1-2, although not particularly limited. The inner peripheral face of the flow path 1-1 of the main pipe rail is slightly projected to flatten by the pressing force of the punch 6, a plastically deformed portion and an elastically deformed portion are formed when the pressing force is applied and a compressive residual stress is generated owing to a deformation caused by a difference in recovery amounts when the pressing force is removed.

Figure 2:
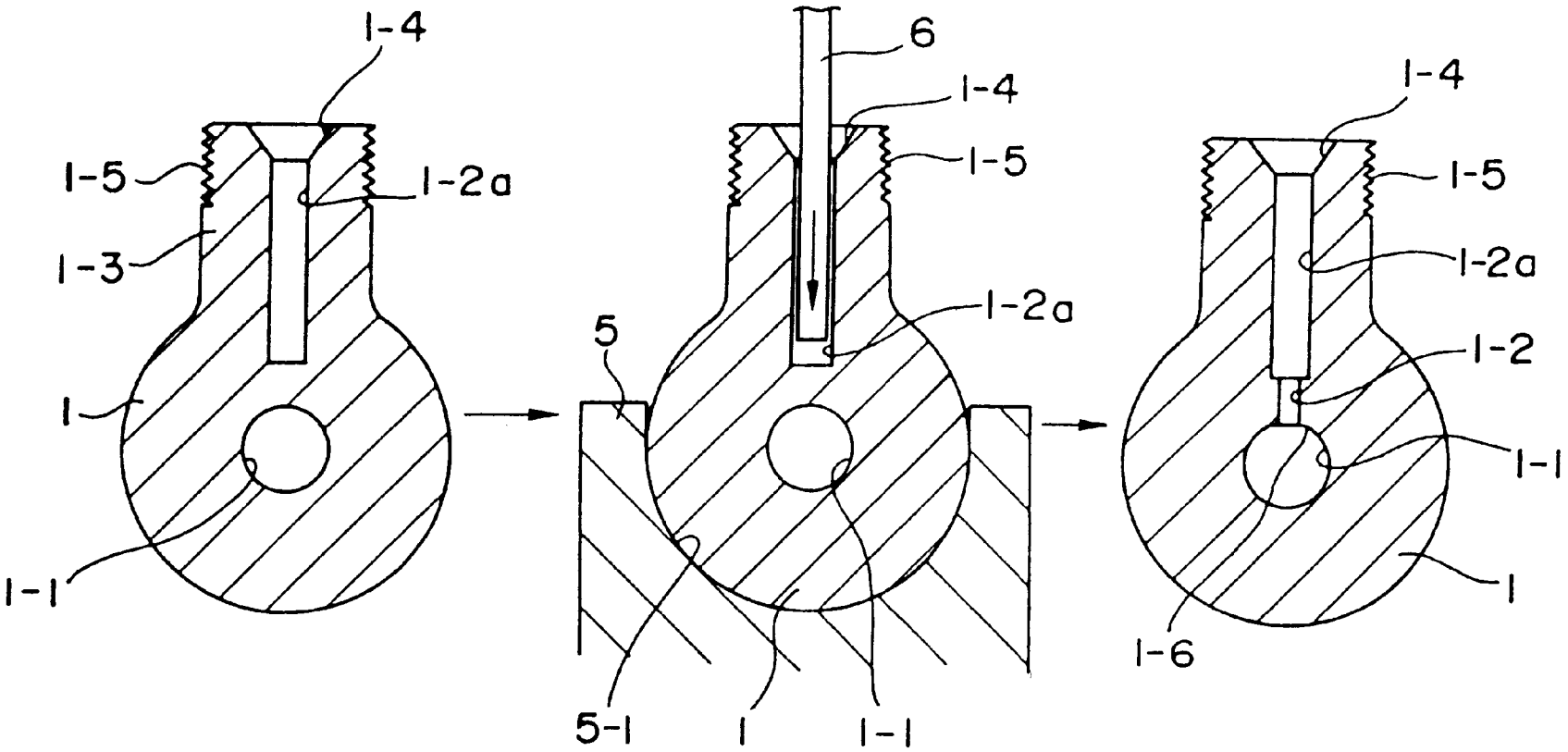
FIG. 2 is an outline view showing a modified example of the first embodiment.

Further, according to a method shown by FIG. 2, firstly, in the previous working step (cutting step), the above-described large diameter branch hole 1-2*a* is formed at each of the boss portions 1-3 of the main pipe rail 1 by cutting it by, for example, an end mill, thereafter, in a pressing step, the vicinities of the boss portions 1-3 of the main pipe rail 1 are fixed by the lower die 5 and a pressing force is applied on the bottom portion of the branch hole 1-2*a* by the punch 6, described above. The pressing force in this case is similarly at the degree of forming the flat portion 1-6 by slightly projecting the inner peripheral face of the flow path 1-1 of the main pipe rail disposed right under the bottom portion of the branch hole 1-2*a*. The flat portion 1-6 is formed by slightly projecting the inner peripheral face of the flow path 1-1 of the main pipe rail by the pressing force by the punch 6, a plastically deformed portion and an elastically deformed portion are caused when the pressing force is applied and a comparative residual stress is generated owing to a deformation caused by a difference in recovery amounts when the pressing force is removed. Thereafter, the branch hole 1-2 having a predetermined hole diameter is perforated at the bottom portion of the branch hole 1-2*a* having a large diameter.

Figure 3A:
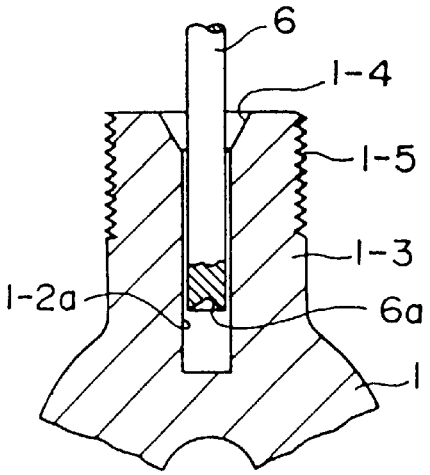
Figure 3B:
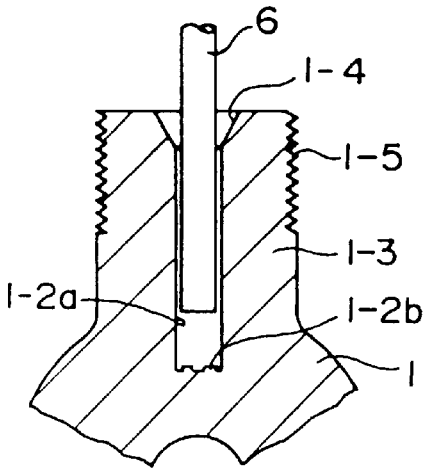

Further, FIGS. 3(A), 3(B), 3(C), 3(D) and 3(E) exemplify pressing force supplying means by a press system for making exist a compressive residual stress at the peripheries of the opening end portions of the flow path of the main pipe rail in which FIG. 3(A) shows a method in which a recess portion 6*a* having a section in a triangular shape is formed at a front end (pressing face) of the punch 6 and the pressing force is applied on the inner bottom portion of the branch hole 1-2*a* having a large diameter of each of the boss portions 1-3 by the punch. In the case of this method, large pressing force is applied not only on the central portion of the bottom portion but on a side of an inner peripheral wall thereof and accordingly, the compressive residual stress can effectively be made to remain over a comparatively wide range of the periphery of each of the branch holes 1-2 installed at the portion. Further, FIG. 3(B) shows a method in which an annular projection 1-2*b* is provided at the inner bottom portion of the branch hole 1-2*a* of each of the boss portions 1-3 and the upper face of the annular projection 1-2*b* is pressed by the punch 6 having a flat pressing face by which similar to the case of FIG. 3(A), the compressive residual stress is made to remain over a comparatively wide range of the periphery of the branch hole 1-2 installed later.

Figure 3C:
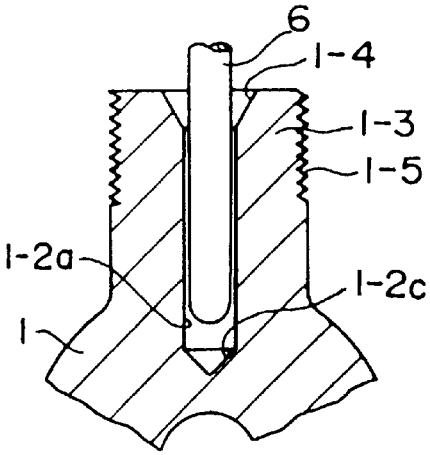

FIG. 3(C) shows a method in which the inner bottom portion of the branch hole 1-2*a* of each of the boss portions 1-3 is constituted by a recess portion 1-2*c* having a section in a reverse triangular shape and the bottom portion comprising the recess portion 1-2*c* is pressed by the punch 6 having a spherical pressing face. According to the method, an inclined face of the bottom portion is firstly pressed by the punch 6 and therefore, also in this case, an effect of making the compressive residual stress remain at the periphery of the branch hole 1-2 installed later is considerable.

Figure 3D:
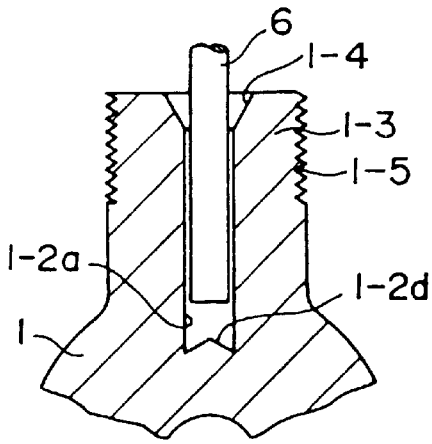

FIG. 3(D) shows a method in which a projection 1-2*d* having a section in a shape of a mountain is provided at the inner bottom portion of the branch hole 1-2*a* of each of the boss portion 1-3 and the bottom portion comprising the projection 1-2*d* is pressed by the punch 6 having a flat pressing face. According to the method, an apex portion of the projection 1-2*d* having a section in a shape of a mountain is firstly pressed by the punch 6 and therefore, a large pressing force is applied on the central portion of the bottom portion. Accordingly, also in this case, a large compressive residual stress is made to remain concentratingly at the vicinity of the peripheral edge of the branch hole 1-2.

Figure 3E:
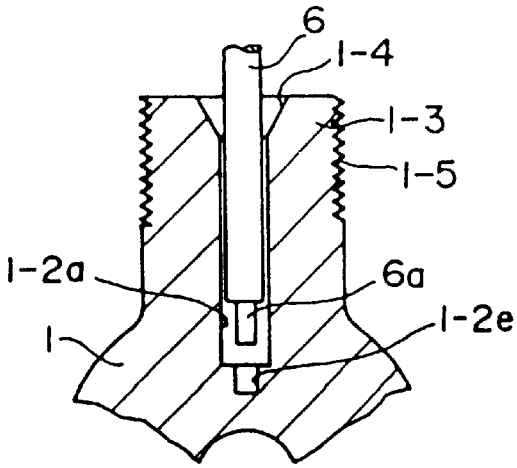

FIG. 3(E) shows a method in which a bottomed hole 1-2*e* having a diameter substantially the same as that of the branch hole 1-2 installed later and a pertinent depth is provide at the center of inner bottom portion of the branch hole 1-2*a* of each of the boss portions 1-3 and the bottomed hole 1-2*e* is pressed by the punch 6 having a diameter insertible into the bottomed hole 1-2*e* and provided with a projection 6*a* more or less longer than the depth of the bottomed hole at its pressing face. According to the case of this method, the bottomed hole 1-2*e* is pressed by the projection 6*a* and at the same time, its periphery is also pressed and accordingly, the pressing force is concentratingly applied on the portion of the branch hole 1-2 installed later and further, the compressive residual stress is necessarily made to remain also at the periphery of the branch hole 1-2.

Figure 4:
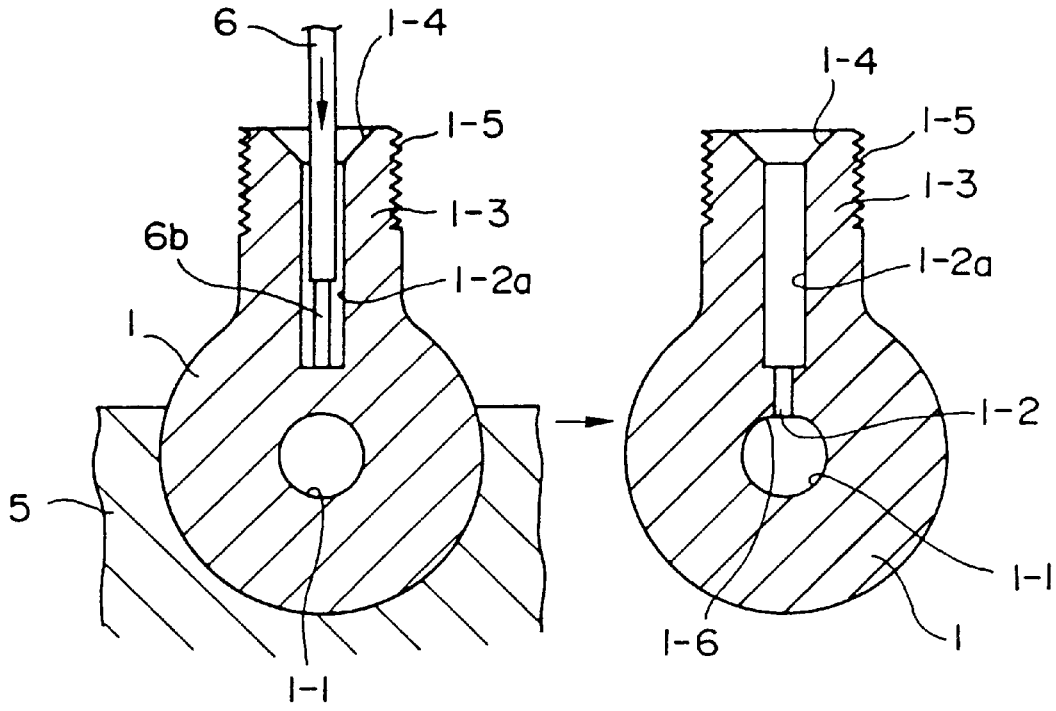
FIG. 4 is an outline view showing an example of a system of punching through a branch hole simultaneously with applying a pressing force according to the first embodiment of the fabrication method.

Further, a system of punching through the branch hole simultaneously with applying the pressing force shown by FIG. 4 is a method in which the punch 6 having a diameter insertible into the bottomed branch hole 1-2*a* installed to each of the boss portions 1-4 and provided with a projection 6*b* having a diameter the same as that of the branch hole 1-2 and longer than the remaining wall thickness at the bottom portion of the bottomed branch hole 1-2*a* at its front end is used and the branch hole 1-2 is punched through while pressing the bottom portion of the branch hole 1-2*a*. According to the case of this method, the bottom portion of the branch hole 1-2*a* is pressed by the projection 6*b* and accordingly, the pressing force is concentratingly applied to the portion of the branch hole 1-2 that is simultaneously punched through and further, a slightly projected flat portion 1-6 is formed and a compressive residual stress is necessarily made to remain also at the periphery of the branch hole 1-2.

Figure 5:
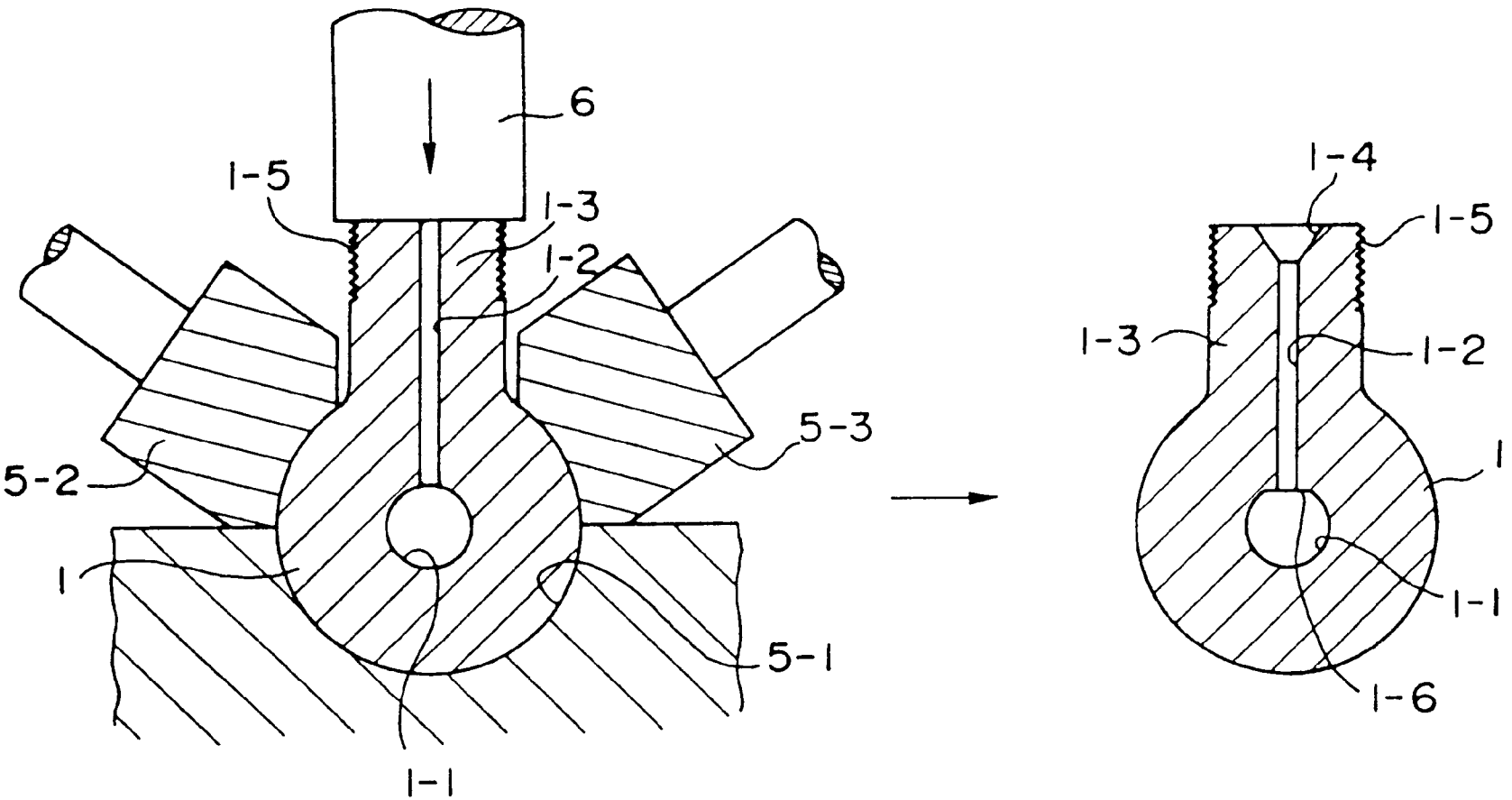
FIG. 5 is an outline view showing other modified example of the first embodiment.

As a method of generating the compressive residual stress by applying the pressing force by the press system according to the present invention, not only the above-described method but a method shown by FIG. 5 can be used.

In FIG. 5, the inner bottom portion of the branch hole 1-2*a* having a large diameter at each of the boss portions 1-3 is not pressed but a pressing force directed in a direction toward the axis is applied on the free end portion of each of the boss portions 1-3 from outside and the method is constituted such that the total of each of the boss portion 1-3 is pressed in a direction toward the axis. That is, the main pipe rail 1 is fixed to the lower die 5 constraining the vicinity of each of the boss portions 1-3 of the main pipe rail 1 provided with the boss portions 1-3 each of which has the branch hole 1-2 formed with a predetermined hole diameter by cutting by, for example, an end mill or the like and on the outer peripheral face of which the outside screw 1-5 is fabricated, successively, left and right movable dies 5-2 and 5-3 are made to constrain the vicinity of each of the boss portions 1-3 by actuators from both sides and the pressing force is applied on the free end portion of the boss portion by the punch 6 attached to a press device. According to the case of the embodiment, substantially the total of the outer periphery in the vicinity of the boss portion 1-3 of the main pipe rail is constrained by the lower die 5 since the boss portion 1-3 in which the branch hole 1-2 is perforated is pressed, the boss portion tends to expand in the direction toward the outer periphery and the tendency is to be restrained.

By such a pressing force by the punch, the inner peripheral face of the flow path 1—1 of the main pipe rail 1 is slightly projected whereby the flat portion 1-6 is formed and further, the compressive residual stress is generated. Thereafter, the main pipe rail is fabricated by forming the pressure receiving seat face 1-4 that is opened outwardly in continuation to the branch hole 1-2. Incidentally, although according to the above-described explanation, an explanation has been given of an example in which the pressing force is applied to an intermediate product in which the outside screw 1-5 and the branch hole 1-2 are fabricated at the outer periphery of the boss portion 1-3, the outside screw 1-5 and the branch hole 1-2 can also be fabricated after applying the pressing force.

Next, explaining with respect to a common rail having boss portions of an inside screw (female screw) type in reference to FIG. 6 through FIG. 10, a main pipe rail 1 comprises a material the same as that of the embodiment shown by FIG. 1 through FIG. 5, a flow path 1—1 is constituted at inside thereof along the axis center, at least one boss portion 1-3 is installed on the peripheral wall portion in the axial direction. Firstly, in a preworking step (cutting step), a bottomed hole 1-2*a*' having a diameter larger than that of the bottomed hole 1-2*a* in the above-described embodiment and a predetermined depth is formed at the boss portion 1-3 of the main pipe rail 1 by cutting it by, for example, an end mill or the like.

Figure 6:
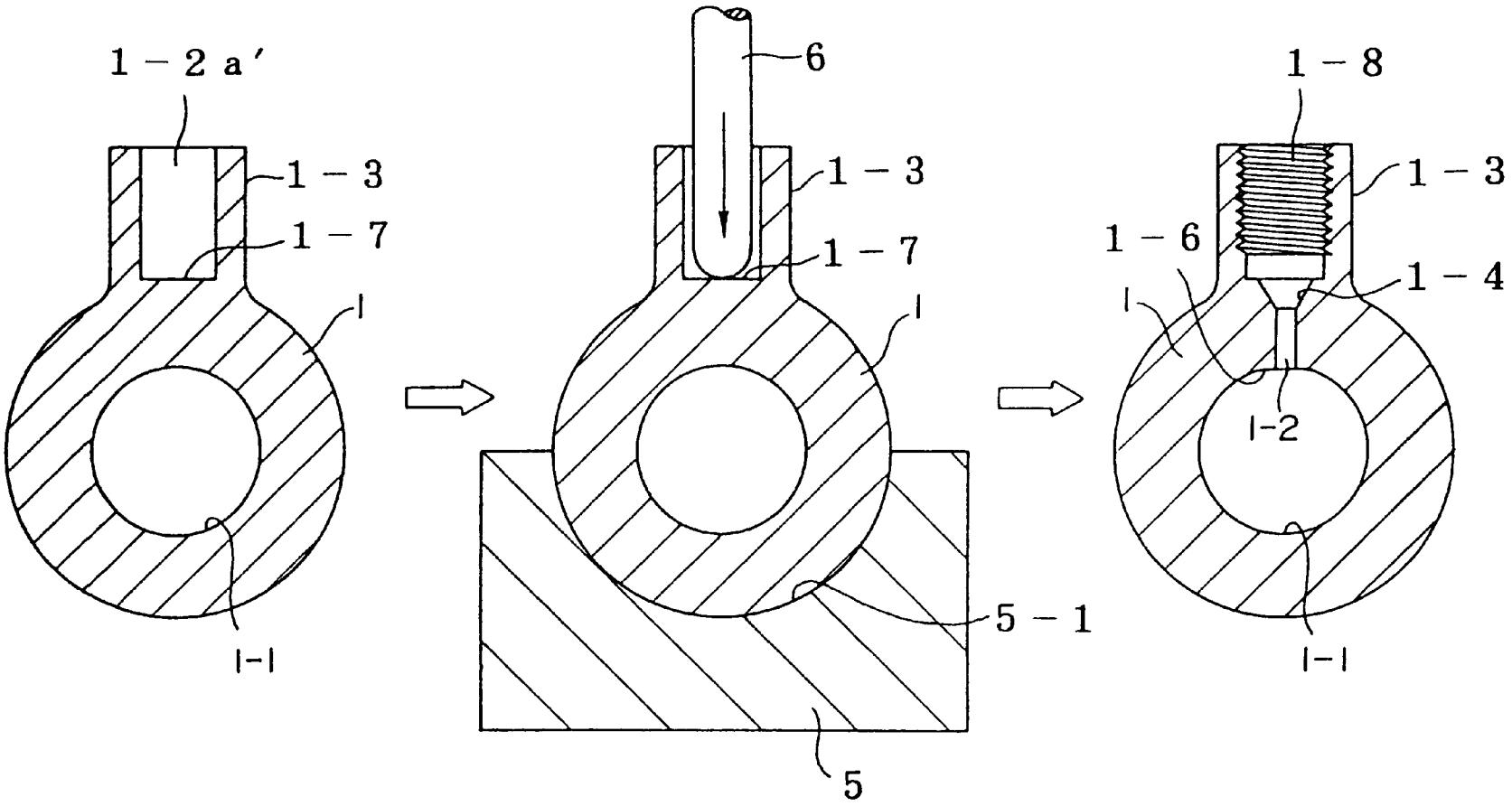
FIG. 6 is an outline view showing a first embodiment of a method of fabricating a common rail having boss portions of an inside screw type integrated with a main pipe rail according to the present invention.

According to a method shown by FIG. 6, successive to the above-described preworking step, in a pressing step, the vicinity of the boss portion 1-3 of the main pipe rail 1 is fixed by the lower die 5. As illustrated, the lower die 5 comprises a metal die having a section in a recess form having a curved face 5-1 with a radius of curvature substantially the same as that of the outer peripheral face of the main pipe rail 1 and the main pipe rail 1 is fixed to the lower die 5 such that substantially a half of the lower periphery of the main pipe rail 1 can be constrained. This is for sufficiently providing the effect of pressing. When the main pipe rail 1 is fixed to the lower die 5, an inner bottom portion 1-7 of the boss portion is applied with the pressing force by the punch 6 which is attached to a press device and the diameter of which is smaller than the inner diameter of the bottomed hole 1-2*a*' of the boss portion 1-3. The pressing force in this case may be at a degree whereby the inner peripheral face of the flow path 1—1 of the main pipe rail disposed right under the inner bottom portion of the boss portion is slightly projected and a flat portion 1-6 is formed, although not particularly limited. The inner peripheral face of the flow path 1—1 of the main pipe rail is slightly projected and flattened by the pressing force by the punch 6 and further, a plastically deformed portion and an elastically deformed portion are caused when the pressing force is applied and a compressive residual stress is generated owing to a deformation caused by a difference in recovery amounts when the pressing force is removed.

Successively, in a finishing step, the branch hole 1-2 which communicates with the flow path 1—1 of the main pipe rail 1 and in which a peripheral face having a circular shape, opened outwardly and communicating with the flow path constitutes a pressure receiving seat face 1-4, is formed at the boss portion 1-3 and an inside screw (female screw) 1-8 is machined on the inner peripheral face of the bottomed hole 1-2*a*' of the boss portion. Incidentally, the inside screw 1-8 may previously be formed in the preworking step.

Figure 7A:
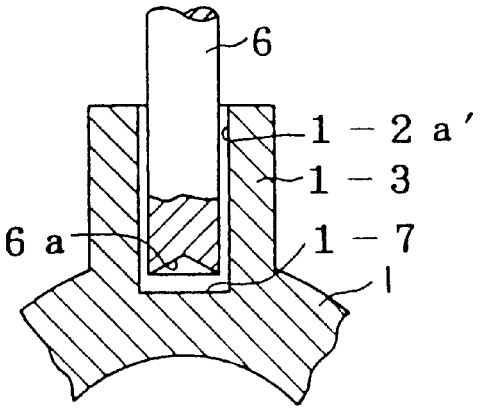
FIGS. 7(A), 7(B), 7(C), 7(D) and 7(E) exemplify pressing force applying means according to the first embodiment of the method of fabricating a common rail having boss portions of an inside screw type
Figure 7B:
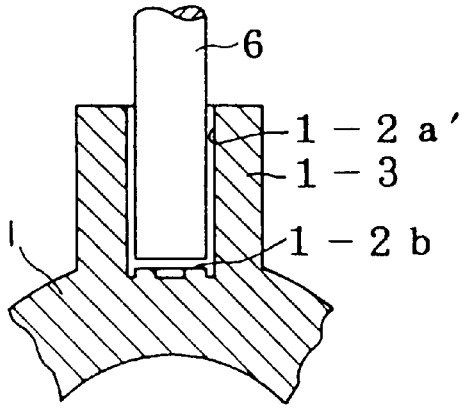
Figure 7C:
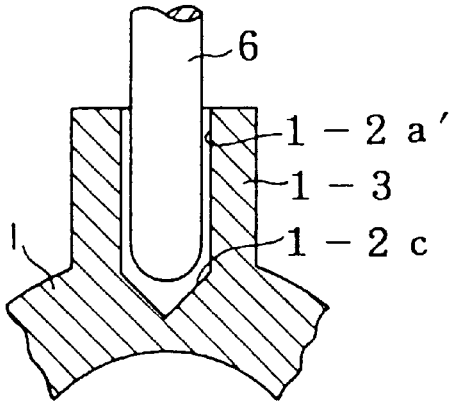
Figure 7D:
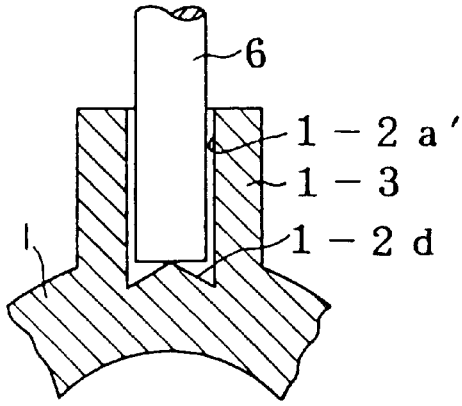
Figure 7E:
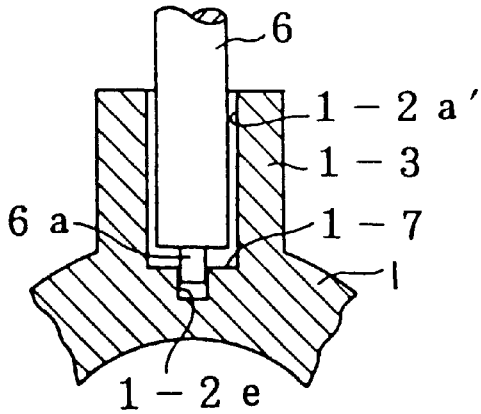

Next, FIGS. 7(A), 7(B), 7(C), 7(D) and 7(E) exemplify pressing force applying means by press system for making a compressive residual stress exist at the periphery of an opening end portion at the flow path of the main pipe rail at the branch hole 1-2 in the common rail having the boss portion 1-3 where the inside screw 1-8 is formed. The pressing force applying means are similar to those of the embodiment shown by FIGS. 3(A), 3(B), 3(C), 3(D) and 3(E), however, the punch 6 having a large diameter needs to be used since the diameter of the bottomed hole 1-2*a*' is larger than that of the bottomed hole 1-2*a* in the embodiment shown by FIGS. 3(A), 3(B), 3(C), 3(D) and 3(E). Explaining of an outline of the embodiment shown by FIGS. 7(A), 7(B), 7(C), 7(D) and 7(E), FIG. 7(A) shows a method of applying the pressing force to the inner bottom portion 1-7 of the bottomed hole 1-2*a*' by the punch 6 having a recess portion 6*a* with a section in a triangular shape formed at its front end portion (pressing face) and in this case, the large pressing force is applied not only to the central portion of the bottom portion but the side of the inner peripheral wall and a compressive residual stress can effectively be made to remain over a comparitively wide range at the periphery of the branch hole 1-2 provided at the portion. Further, FIG. 7(B) shows a method of pressing the upper face of an annular projection 1-2*b* provided at the inner bottom portion 1-7 of the bottomed hole 1-2*a*' by a flat pressing face of the punch 6 and a compressive residual stress is made to remain over a comparatively wide range of the periphery of the branch hole 1-2, provided later similar to that of FIG. 3(A). Further, FIG. 7(C) shows a method of pressing a recess portion 1-2*c* having a section in a reverse triangular shape formed at the inner bottom portion 1-7 of the boss portion 1-3, in which the inclined face of the bottom portion is firstly pressed by the punch 6 and accordingly, an effect of making a compressive residual stress remain at the peripheral of the branch hole 1-2, provided later is considerable also in this case. Further, FIG. 7(D) shows a method of pressing the bottom portion of a projection 1-2*d* having a section in a shape of a mountain provided at the inner bottom portion 1-7 of the boss portion 1-3 by a flat pressing face of the punch 6 and according to this method, the apex of the projection 1-2*d* with a section in a shape of a mountain is firstly pressed by the punch 6 and accordingly, the large pressing force is applied to the central portion of the bottom portion and also in this case, a large compressive residual stress is made to remain concentratingly at the vicinity of the peripheral edge of the branch hole 1-2 installed later. Further, FIG. 7(E) shows a method of pressing by the punch 6, the pressing face of which is installed with a projection 6*a* having a diameter insertible into a bottomed hole 1-2*e* having a diameter substantially the same as the diameter of the branch hole 1-2 installed later at the center of the inner bottom portion of the boss portion 1-3 and a pertinent depth and more or less longer than the depth of the bottomed hole and in this case, the bottomed hole 1-2*e* is pressed by the projection 6*a* and at the same time, a periphery thereof is also pressed and accordingly, the pressing force is applied concentratingly to the portion of the branch hole 1-2 installed later and a compressive residual stress is made to remain necessarily also at the periphery of the branch hole 1-2. Also in these cases of the embodiment, the shape of the front end of the punch and the shape of the inner bottom portion of the boss portion are not limited by combinations of these shapes.

Figure 8:
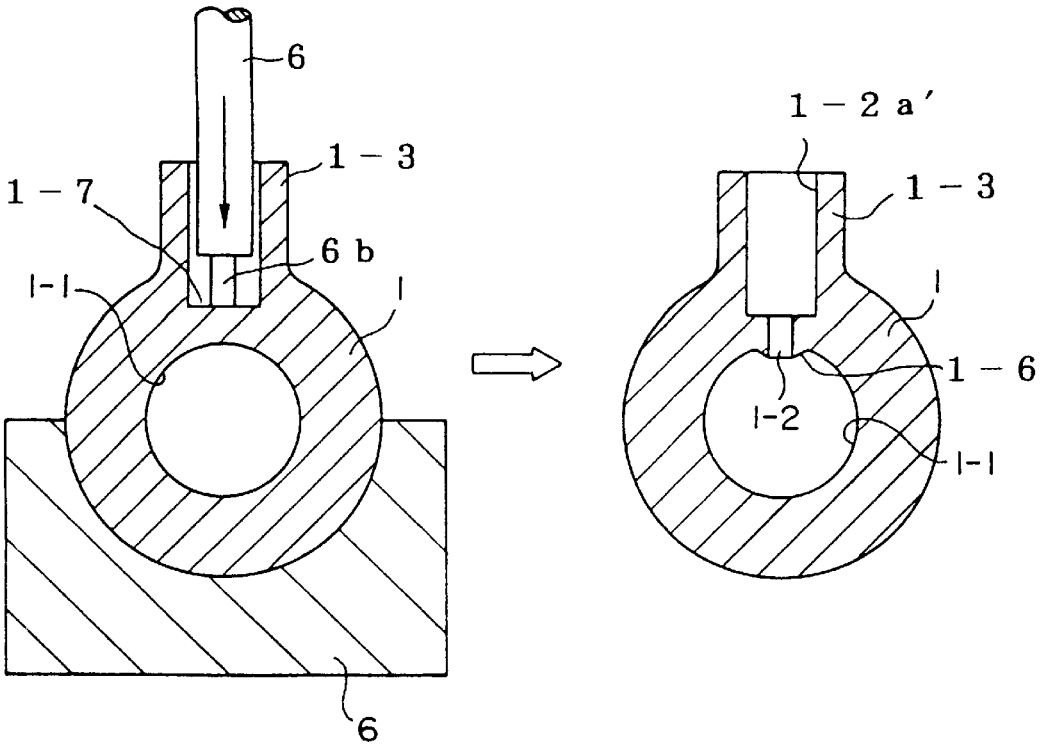
FIG. 8 is a longitudinal sectional view of a boss portion showing an example of a system of punching through a branch hole simultaneously with applying a pressing force according to the first embodiment of the fabrication method.

Further, FIG. 8 shows an example of a system of punching through the punch hole simultaneously with applying the pressing force according to the fabrication method of the first embodiment of the common rail having the boss portions of the inside screw type which is a method in which the punch 6 having a diameter insertible into the bottomed hole 1-2*a*' installed to the boss portion 1-3 and provided with a projection 6*b* having a diameter the same as the diameter of the branch hole 1-2 and longer than the remaining wall thickness of the inner bottom portion 1-7 of the bottomed hole 1-2*a*' at its front end and the branch hole 1-2 is punched through while pressing the inner bottom portion 1-7 of the bottomed hole 1-2*a*'. According to the case of this method, the inner bottom portion 1-7 of the bottomed hole 1-2*a*' is pressed by the projection 6*b* and accordingly, the pressing force is applied concentratingly at the portion of the branch hole 1-2 that is punched through simultaneously and a compressive residual stress is necessarily made to remain also at the periphery of the branch hole 1-2.

Figure 9:
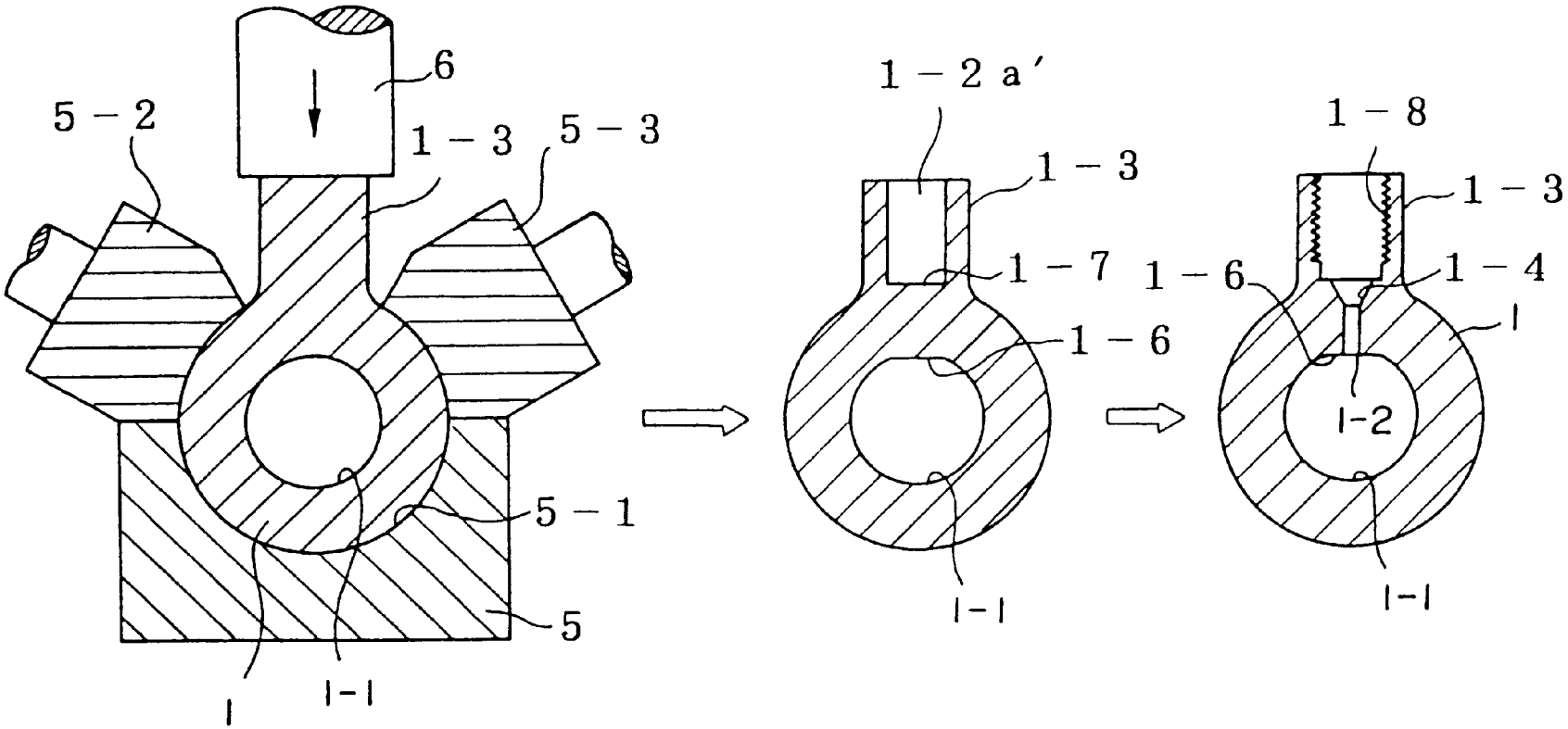
FIG. 9 is an outline view showing a modified example of the first embodiment of a method of fabricating a common rail of an inside screw type according to the present invention.

As the method of applying the pressing force and generating the residual compressive stress by the press system according to the present invention, not only the above-described method but a method as shown by FIG. 9 can be used.

Firstly, in FIG. 9, the main pipe rail 1 having the boss portions 1-3 is fixed to the lower die 5, successively, the vicinities of the boss portions 1-3 of the main pipe rail 1 are constrained from both sides by left and right movable dies 5-2 and 5-3 by using actuators and the pressing force is applied to the free end portion of the boss portions by the punch 6 attached to a press device. By the pressing force by the punch, the inner peripheral face at the flow path 1—1 of the main pipe rail 1 is slightly projected and a flat portion 1-6 is formed and further, a compressive residual stress is generated. The procedure up to this point is similar to that in the case of a common rail having a boss portion of an outside screw type.

Next, the bottomed hole 1-2*a* having a predetermined diameter and a predetermined depth is formed at the boss portion 1-3 of the main pipe rail 1 by cutting, thereafter, the branch hole 1-2 communicating with the flow path 1—1 of the main pipe rail 1 and having a peripheral face communicating with the flow path, in a circular shape and opened outwardly for constituting a pressure receiving seat face 1-4, is formed at the boss portion 1-3 and an inside screw 1-8 or the like is machined on the inner peripheral face of the bottomed hole 1-2*a*' of the boss portion whereby the main pipe rail 1 is fabricated.

Figure 10:
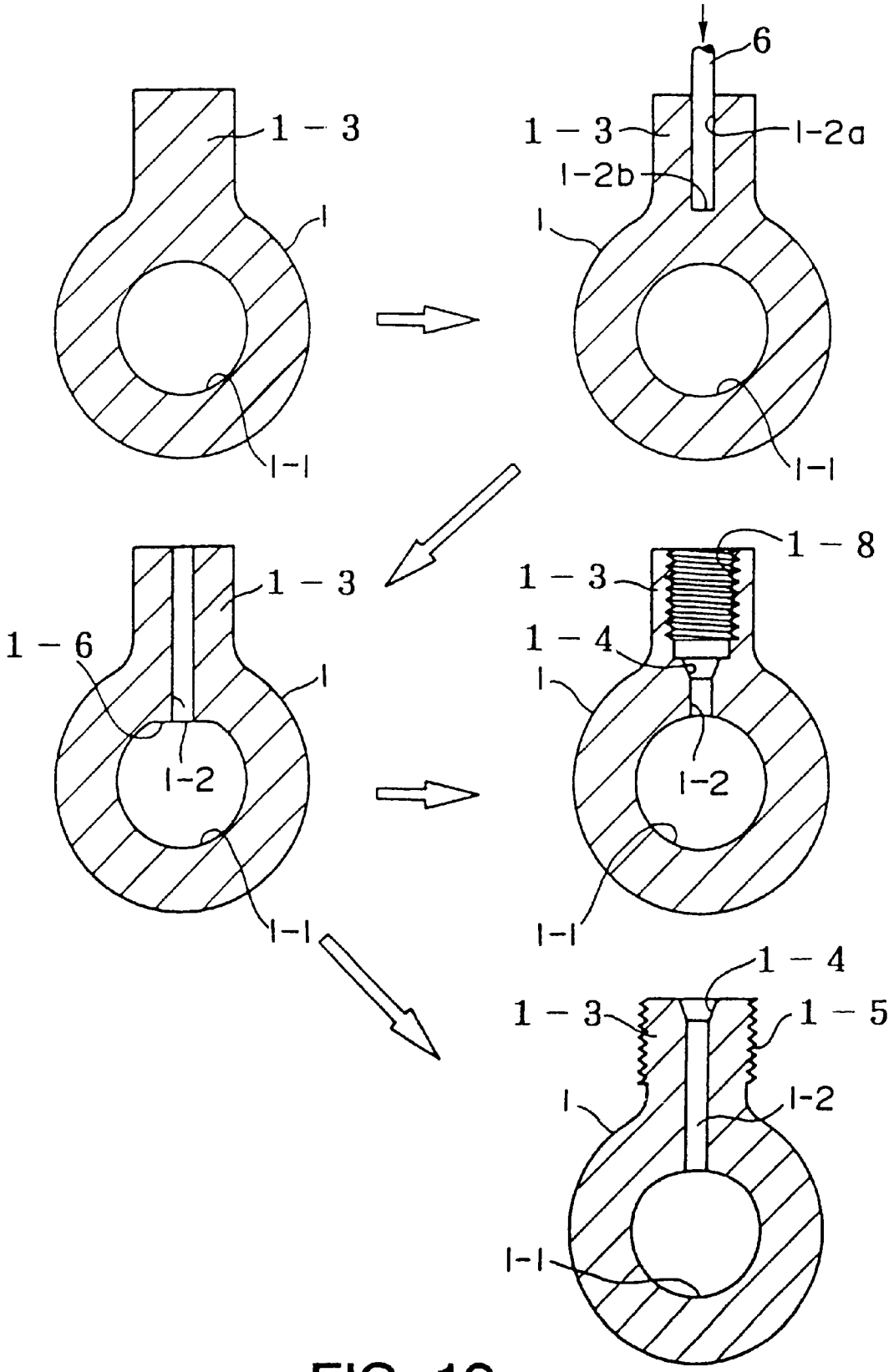
FIG. 10 is an outline view showing other modified example of the first embodiment of a method capable of fabricating either of a common rail of an outside screw type and a common rail of an inside screw type according to the present invention.

Next, a method shown by FIG. 10 is a method capable of pertinently selecting to constitute either of a common rail having a boss portion of an inside screw type and a common rail having a boss portion of an outside screw type after application of the pressing force. According to the fabrication method, a bottomed hole 1-2*a* having a diameter substantially the same as that of the branch hole 1-2 installed later and a pertinent depth, is installed from a free end portion of the boss portion 1-3 in the axial direction and the inner bottom portion 1-7 of the bottomed hole 1-2*a* is pressed by the punch 6 having a diameter insertible into the bottomed hole 1-2*a* and longer than the depth of the bottomed hole by which the inner bottom portion 1-7 is pressed by the punch 6 and accordingly, the pressing force is applied concentratingly to the portion of the branch hole 1-2 installed later and the compressive residual stress is necessarily made to remain also at the periphery of the branch hole 1-2. In this embodiment of FIG. 10, thereafter, the branch hole 1-2 is formed by extending the bottomed hole 1-2*a* to the flow path 1—1 by cutting by using a drill or the like.

Successively, a common rail having a boss portion of an inside screw type is formed by forming a bottomed hole 1-2*a*' having a large inner diameter and a predetermined depth at the boss portion 1-3 of the main pipe rail 1 by cutting and thereafter forming the pressure receiving seat face 1-4 at the bottomed hole 1-2*a*' and machining the inside screw 1-8 on the inner periphery of the boss portion, or a common rail having a boss portion of an outside screw type is constituted by forming the pressure receiving seat face 1-4 at an end face of the free end of the boss portion 1-3 of the branch hole 1-2 and thereafter machining the outside screw 1-5.

Further, as a method of applying the pressing force by a press system by using a punch or the like and generating a compressive residual stress, pressing is performed slightly eccentrically from a portion for installing the branch hole and the compressive residual stress may be generated and made to remain concentratingly at at least a portion of the branch hole, that is, on the inner peripheral edge portion P in the axial direction of the main pipe rail 1 at the lower end of the branch hole constituting the onset of cracks.

Figure 11:
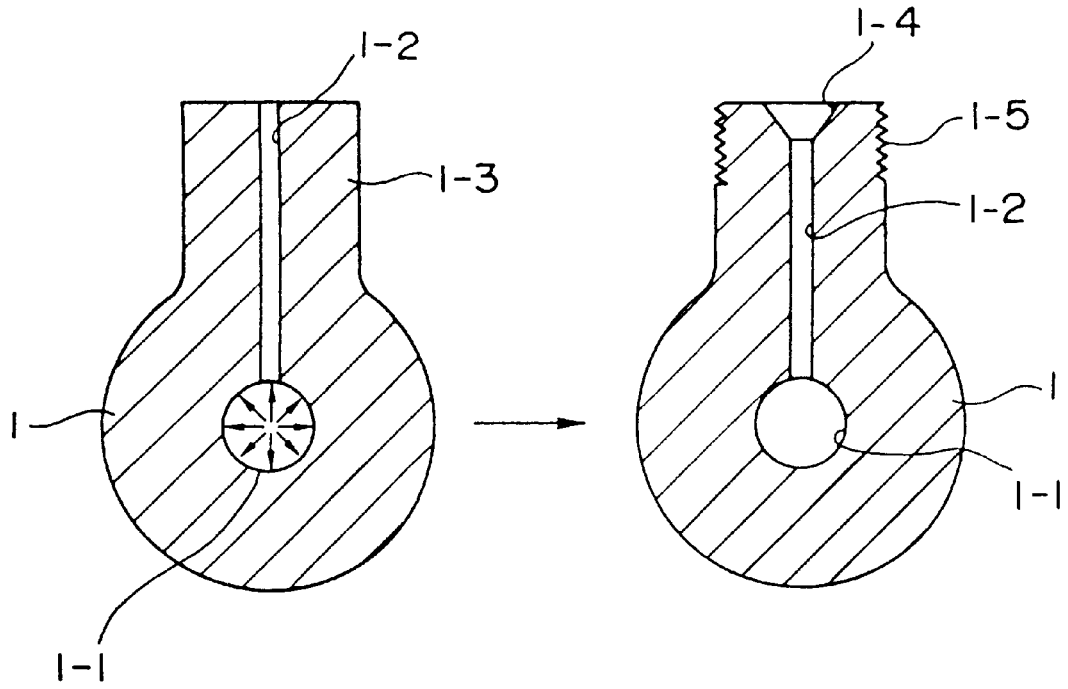
FIG. 11 and FIG. 12 are outline views respectively showing a second embodiment of a method of fabricating common rails having boss portions of an outside screw type and an inside screw type integrated with a main pipe rail according to the present invention.
Figure 12:
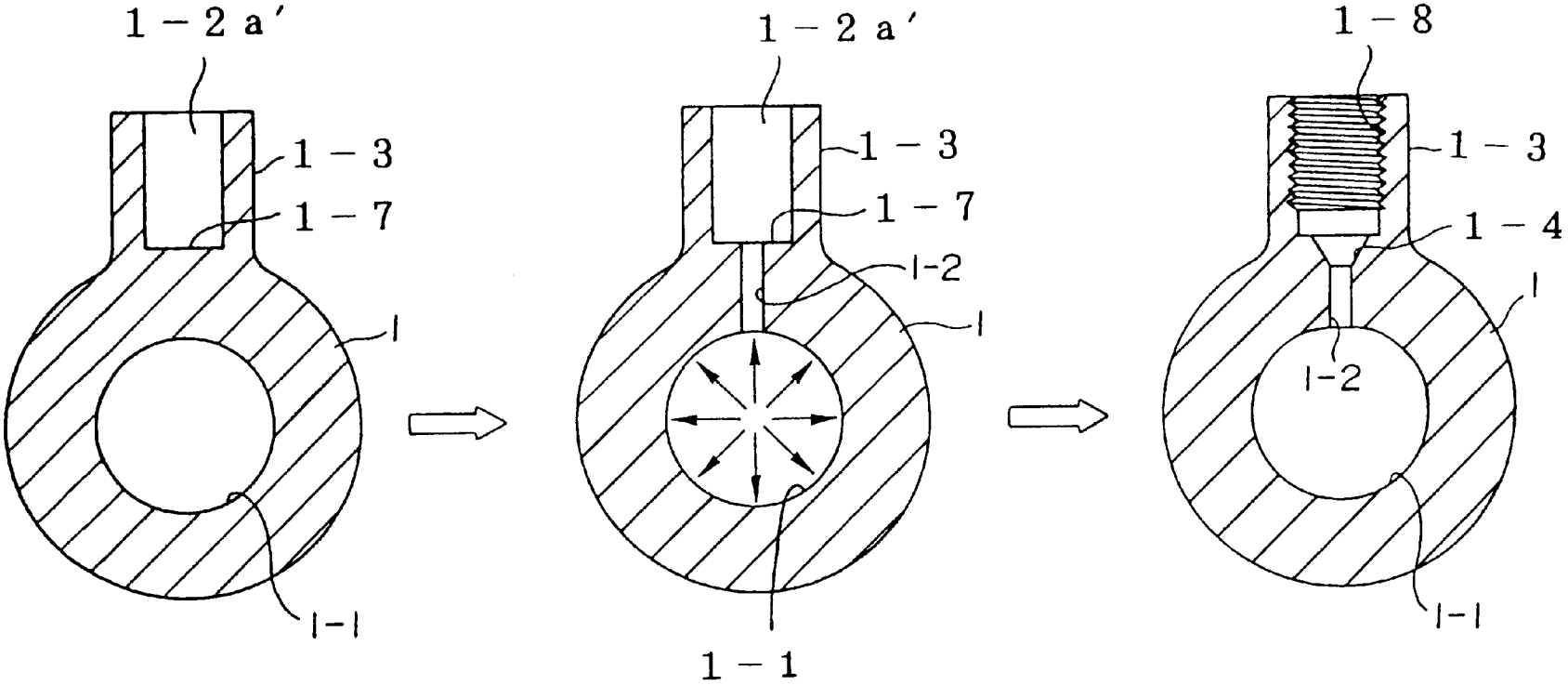

Next, methods illustrated by FIG. 11 and FIG. 12 show examples of adopting an inner pressure system in which pressure is applied at inside of the flow paths 1—1 of the main pipe rail 1 (refer to FIG. 11) having a boss portion of an outside screw type and the main pipe rail 1 (refer to FIG. 12) having a boss portion of an inside screw type, respectively. In order to generate a compressive residual stress at the periphery of the opening end portion at the flow path 1—1 of the main pipe rail in the branch hole 1-2 of the main pipe rail 1, in the case of FIG. 11, one end of the main pipe rail 1 is blocked, a liquid fluid such as water or oil is transmitted into the flow path 1—1 of the main pipe rail, high pressure whereby at least 25%, preferably 50 through 75% of the wall thickness of the main pipe rail 1 is yielded from the inner peripheral face side and the compressive residual stress is generated at the periphery of the opening end portion at the flow path of the main pipe rail at the vicinity of the boss portion 1-3. Thereafter, in a finishing step, the pressure receiving seat face 1-4 in a circular shape opened outwardly is formed at the outer end portion of the branch hole 1-2 and the outside screw 1-5 is machined on the outer peripheral face of the boss portion. Meanwhile, in the case of FIG. 12, the bottomed hole 1-2*a*' is previously formed at the boss portion 1-3 by cutting, the pressing force is provided by applying high pressure at inside of the flow path 1—1 of the main pipe rail 1 where the branch hole 1-2 communicating with the flow path 1—1 is perforated from the inner bottom portion 1-7 of the bottomed hole 1-2*a*' similar to the case of FIG. 11 and the compressive residual stress is generated at the periphery of the opening end portion at the flow path of the main pipe rail 1 in the branch hole 1-2. Thereafter, in a finishing step, the pressure receiving seat face 1-4 is formed at the inner bottom portion 1-7 and the inside screw 1-8 is machined on the inner peripheral face of the bottomed hole 1-2*a*'. Further, it is preferable to machine the branch hole 1-2 before applying the inner pressure in order to make firmly remain the compressive stress in either of the embodiments of FIG. 11 and FIG. 12.

Figure 13:
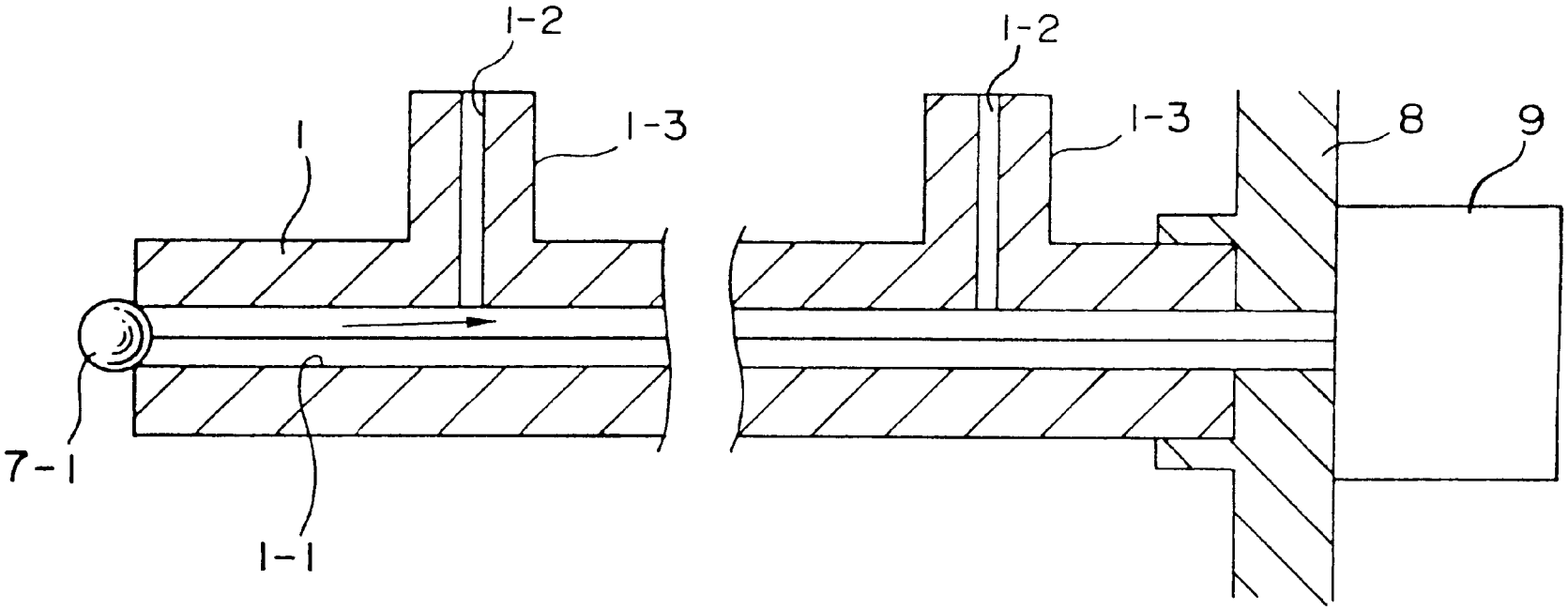
FIG. 13 and FIG. 14 are outline views respectively showing a third embodiment of a method of fabricating common rails of an outside screw type and an inside screw type similarly according to the present invention.
Figure 14:
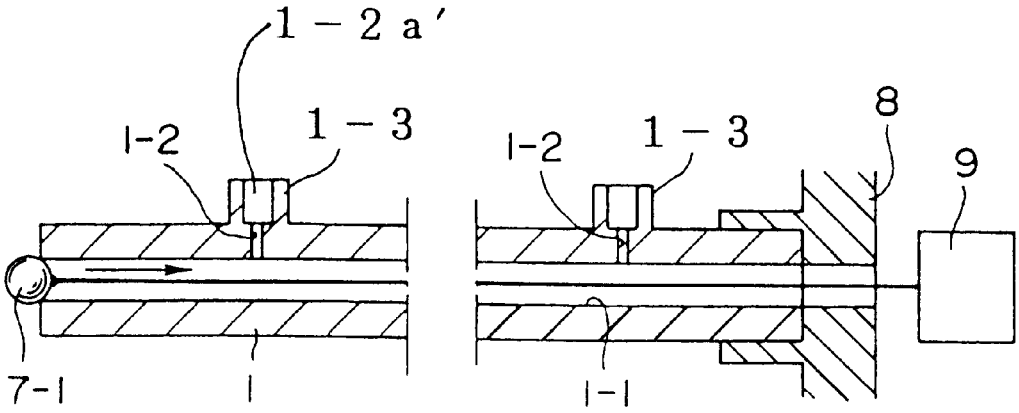

Further, methods illustrated by FIG. 13 and FIG. 14 show examples of adopting a pipe expanding system for applying pressure in a direction of the pipe diameter from insides of the main pipe rail 1 (refer to FIG. 13) having a boss portion of an outside screw type and the main pipe rail 1 (refer to FIG. 14) having a boss portion of an inside screw type, respectively. In the case of FIG. 13, in order to generate a compressive residual stress at the periphery of the opening end portion of the flow path 1—1 of the main pipe rail in the branch hole 1-2 of the main pipe rail 1, the compressive residual stress is generated at the periphery of the opening end portion of the flow path 1—1 of the main pipe rail at the vicinity of the boss portion 1-3 by expanding the flow path 1—1 of the main pipe rail 1 by a method of moving a spherical body 7-1 having a diameter slightly larger than the inner diameter of the main pipe rail by the pulling device 9 while bringing the spherical body 7-1 in press contact with the inside of the flow path 1—1 in a state where the main pipe rail 1 is fixed to the fixing jig 8 horizontally. Thereafter, in a finishing step, the branch hole 1-2 communicating with the flow path 1—1 of the main pipe rail 1 and constituting the pressure receiving seat face 1-4 communicated with the flow path, in a circular shape and opened outwardly, is formed at each of the boss portions 1-3 and the outside screw 1-5 is machined on the outer peripheral face of each of the boss portions.

Meanwhile, in the case of FIG. 14, the bottomed hole 1-2*a*' is previously formed at each of the boss portions 1-3 by cutting, the pressing force is applied to the inside of the flow path 1—1 of the main pipe rail 1 perforated with the branch holes 1-2 each communicating with the flow path 1—1 from the inner bottom portion 1-7 of the bottomed hole 1-2*a*' by expanding the main pipe rail 1 similar to the case of FIG. 13 and the compressive residual stress is generated at the periphery of the opening end of the flow path of the main pipe rail 1 in the branch hole 1-2. Thereafter, in a finishing step, the pressure receiving seat face 1-4 is formed at the inner bottom portion 1-7 and the inside screw 1-8 is machined on the inner peripheral face of the bottomed hole 1-2*a*'.

Figure 16:
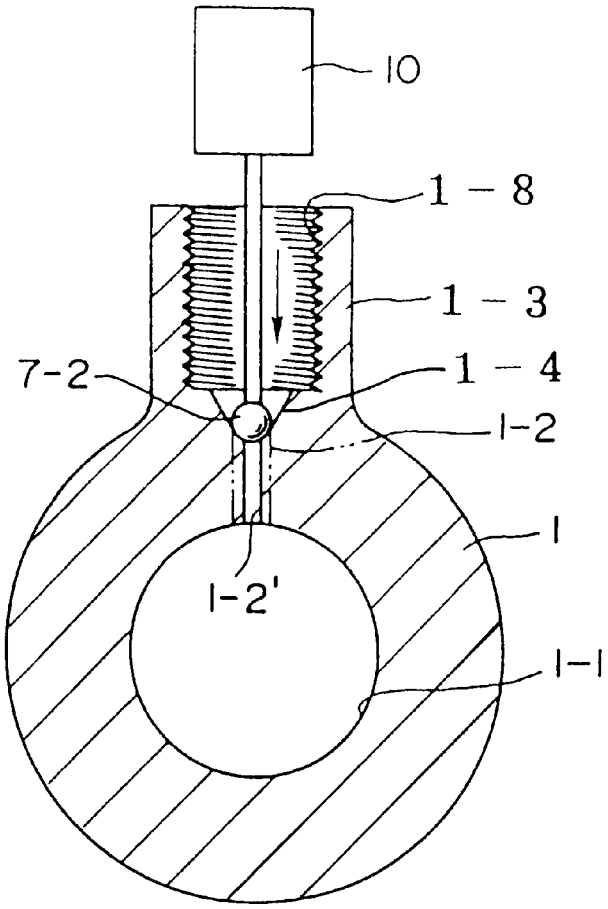
FIG. 15 and FIG. 16 are outline views showing a fourth embodiment of a method of fabricating common rails of an outside screw type and an inside screw type similarly according to the present invention.
Figure 15:
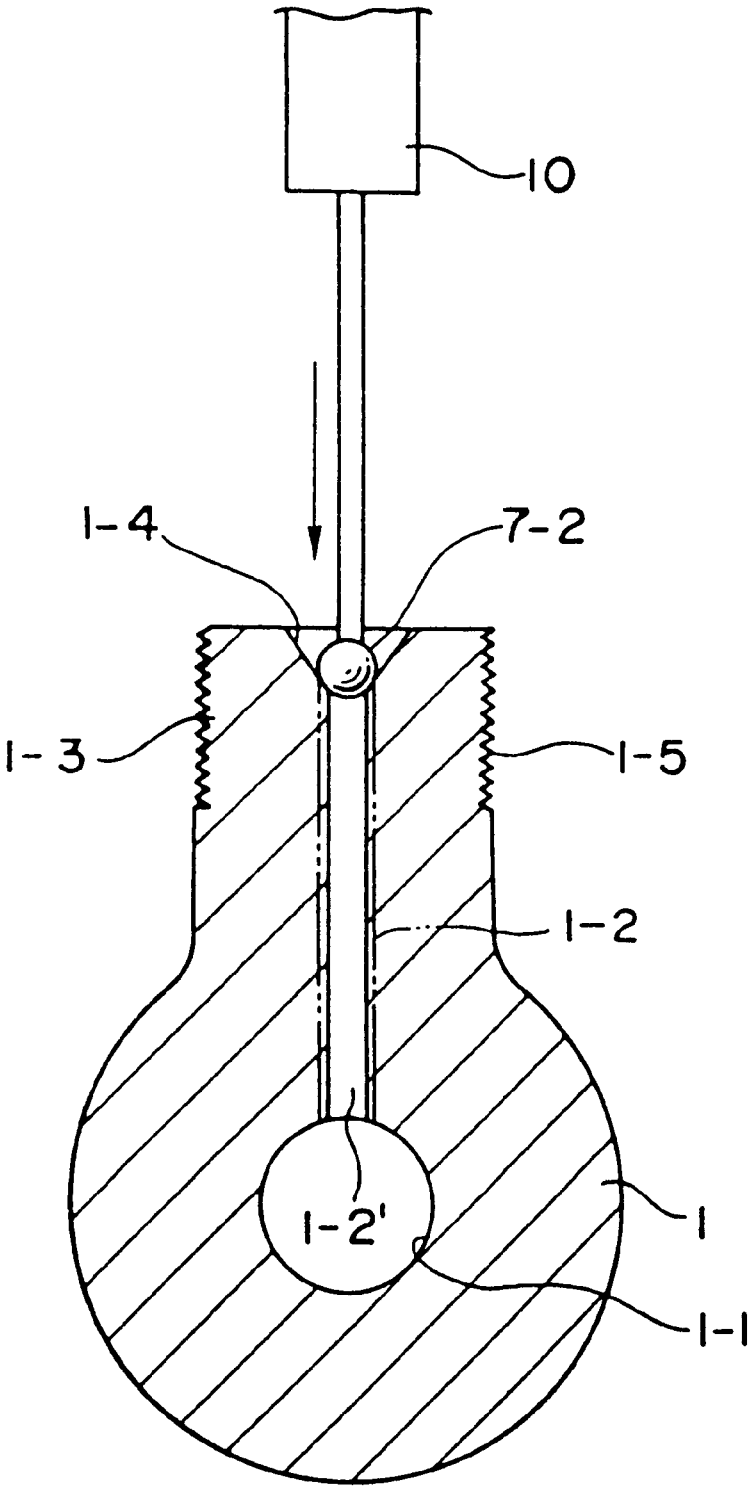

Further, methods illustrated by FIG. 15 and FIG. 16 show examples of adopting a diameter expanding system where pressure is applied in the diameter direction from insides of a branch hole (refer to FIG. 15) of a boss portion of an outside screw type and a branch hole (refer to FIG. 16) of a boss portion of an inside screw type, respectively. In the case of FIG. 15, in order to generate a compressive residual stress at the periphery of the opening end portion of the flow path 1—1 of the main pipe rail in the branch hole 1-2, the compressive residual stress is generated at the periphery of the opening end portion of the flow path of the main pipe rail in the branch hole 1-2 by expanding the diameter of the branch hole 1-2' by a method where the branch hole 1-2' having a diameter slightly smaller than a predetermined hole diameter is perforated at the boss portion 1-3 where the outside screw 1-5 is machined in a finishing step and a spherical body 7-2 having a diameter substantially the same as the inner diameter of the branch hole 1-2 having the predetermined hole diameter, is pressed into the branch hole 1-2' having a small diameter by a pressing system.

Meanwhile, in the case of FIG. 16, the compressive residual stress is generated at the periphery of the opening end portion of the flow path of the main pipe rail in the branch hole 1-2 by expanding the diameter of the branch hole 1-2' by a method where the branch hole 1-2' having a diameter slightly smaller than a predetermined hole diameter is perforated between the inner bottom portion 1-7 and the flow path 1—1 in the boss portion 1-3 where the inside screw 1-8 is machined on the inner peripheral face of the bottomed hole 1-2*a*' in a finishing step and a spherical body 7-2 having a diameter substantially the same as the inner diameter of the branch hole 1-2 having the predetermined hole diameter is pressed into the branch hole 1-2' having a small diameter by a pressing system.

Figure 17A:
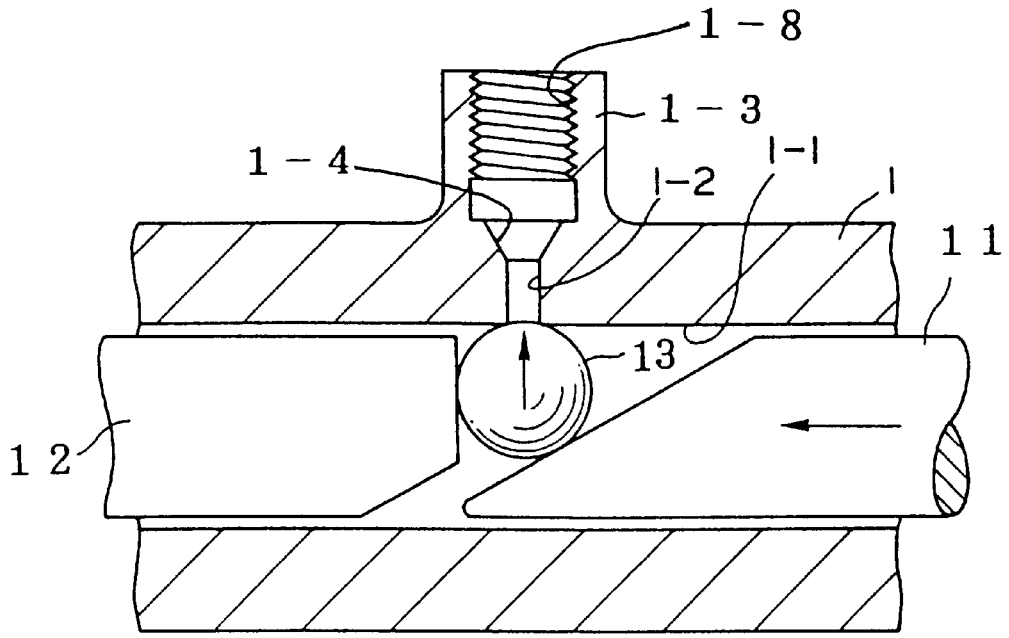

Next, a method illustrated by FIG. 17(A) exemplifies a method of generating a compressive residual stress at the opening end portion of the flow path of the main pipe rail in the branch hole 1-2 by using a steel ball 13. The steel ball 13 and the rod-like steel ball receiver 12 are inserted into the main pipe rail 1, the steel ball receiver 12 is arranged such that the spherical face of the steel ball 13 is brought into contact with the opening end portion of the flow path of the main pipe rail in the branch hole 1-2, the punch 11 having a front end portion formed in a wedge-like shape is inserted from other end portion of the main pipe rail and the steel ball 13 is mounted on an inclined sliding face of the front end portion. When the punch 11 is pushed in under the state, a force in the direction of the branch hole is exerted to the steel ball 13 by a wedge action of the front end portion of the punch 11 whereby the steel ball 13 is pushed to the opening end portion of the flow path of the main pipe rail in the branch hole 1-2. Further, the steel ball 13 is strongly pushed to the opening end portion of the flow path of the main pipe rail by exerting a load by pushing in the punch 11 until necessary pressure is reached and thereafter, the steel ball 13, the steel ball receiver 12 and the punch 11 are removed from the main pipe rail 1. In the case of this method, the pressing force is applied to the opening end portion of the flow path of the main pipe rail in the branch hole 1-2 by the steel ball 13 pressed by the punch 11 and accordingly, a compressive residual stress can effectively be generated and made to remain at the periphery of the opening end of the flow path of the main pipe rail in the branch hole 1-2.

Figure 17B:
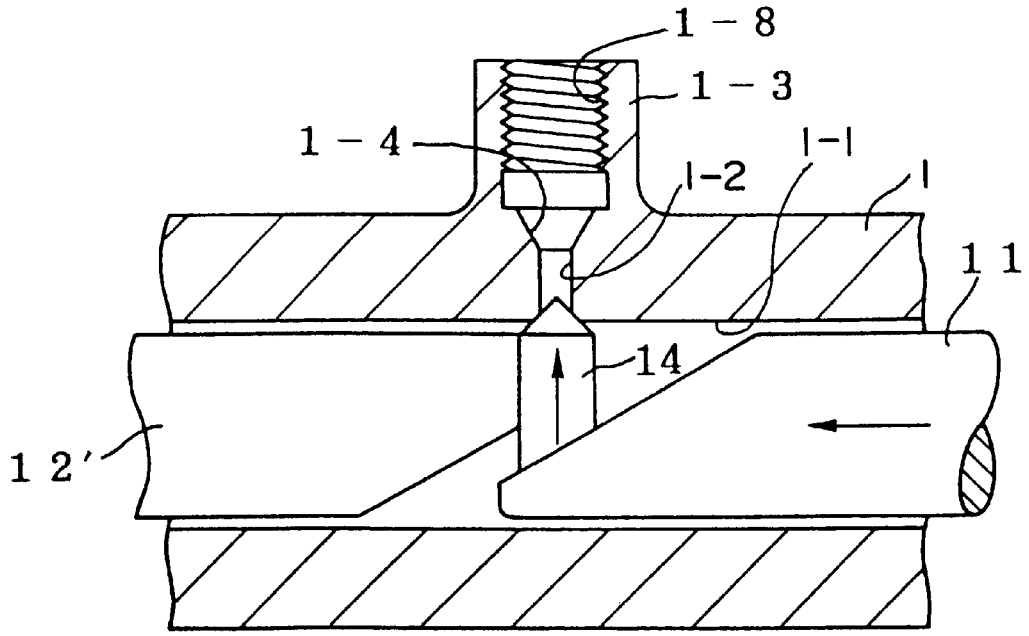
Figure 18A:
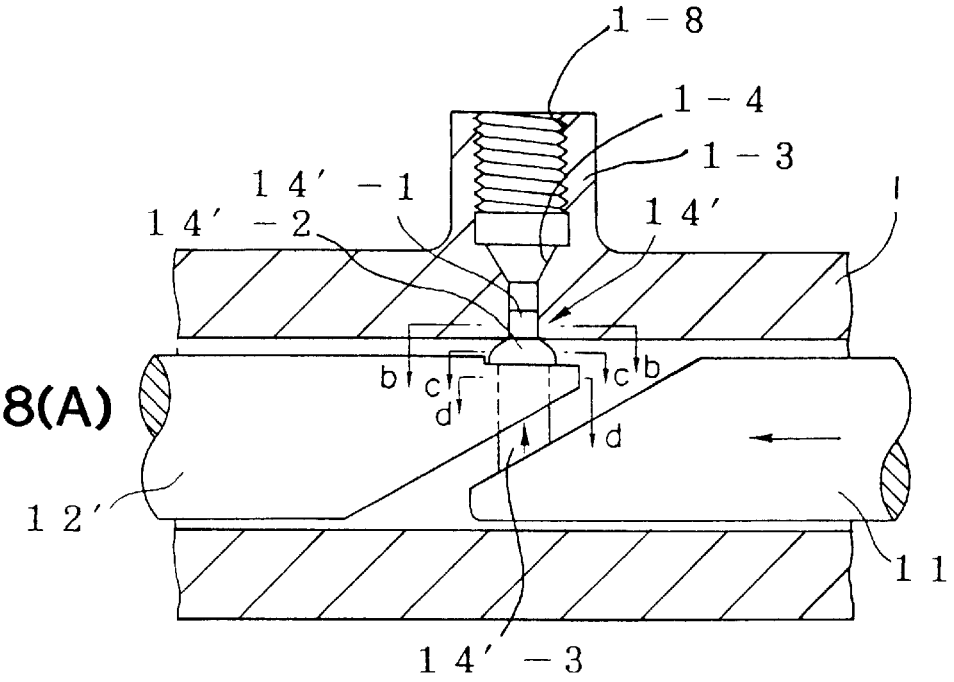
Figure 18B:
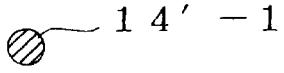
Figure 18C:
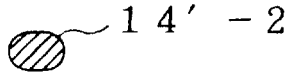
Figure 18D:
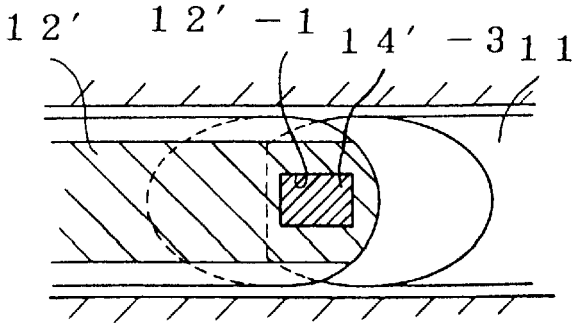
Figure 19:
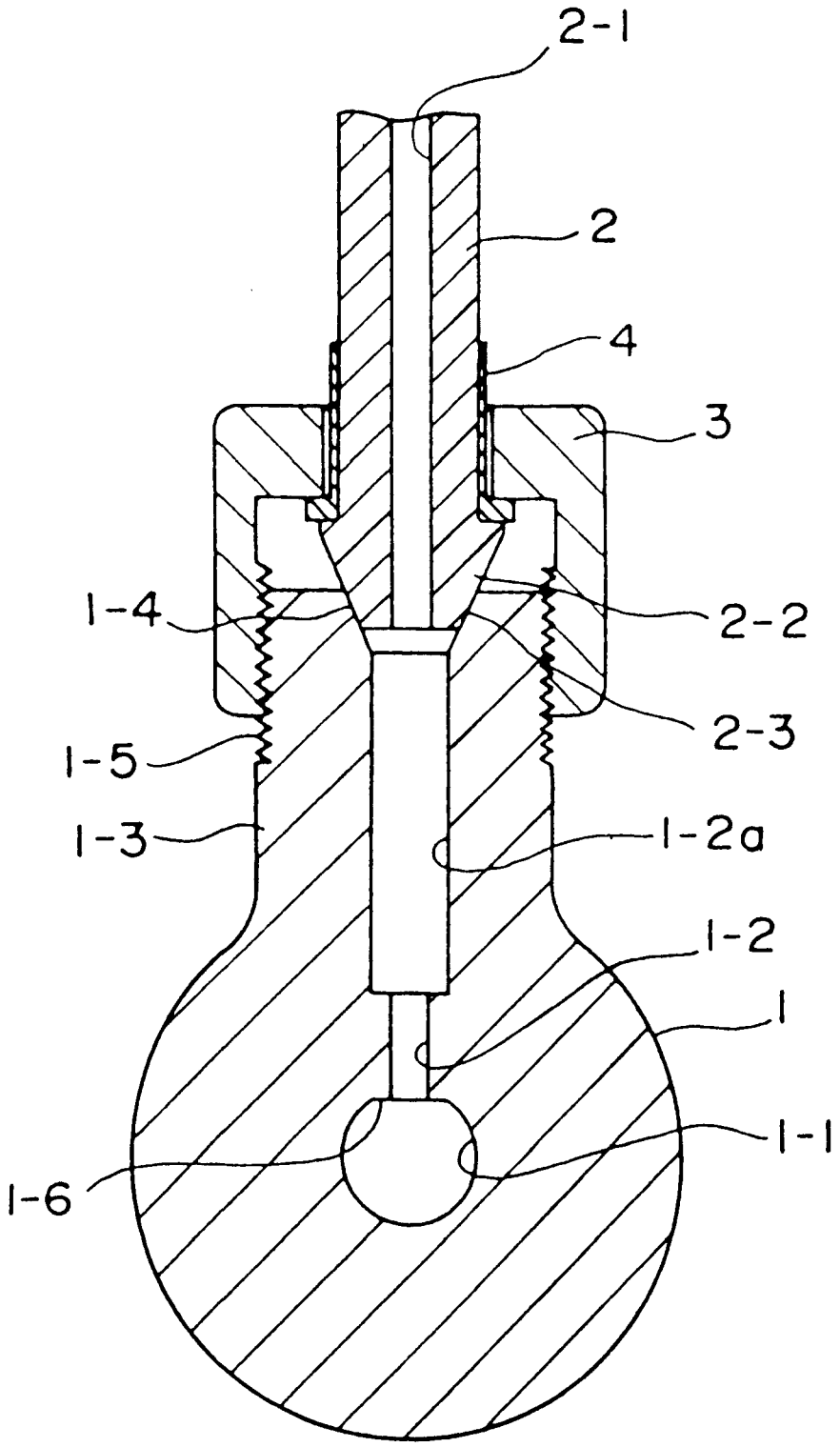
FIG. 19 is a longitudinal sectional view showing an example of a structure of connecting a branch pipe according to a method of fabricating a common rail having boss portions of an outside screw type integrated with a main pipe rail.

A method illustrated by FIG. 17(B) exemplifies a method of generating a compressive residual stress at the opening end portion of the flow path of the main pipe rail in the branch hole 1-2 by using a slug 14 having a conical front end in place of the steel ball 13. Similar to the operational procedure in the above-described case, the slug 14 and the rod-like slug receiver 12' are inserted into the main pipe rail 1, the slug receiver 12' is arranged such that the conical face of the slug 14 is brought into contact with the opening end portion of the flow path of the main pipe rail in the branch hole 1-2, the punch 11 having a front end portion formed in a wedge-like shape is inserted from other end portion of the main pipe rail and the slug 14 is mounted on the inclined sliding face of the front end portion. When the punch 11 is pushed in under the state, similar to the case of the steel ball, the slug 14 is pushed to the opening end portion of the flow path of the main pipe rail at the branch hole 1-2 by exerting a force in the direction of the branch hole to the slug 14 by a wedge action of the front end portion of the punch 11. Further, the slug 14 is strongly pushed to the opening end portion of the flow path of the main pipe rail by exerting a load by pushing the punch 11 until necessary pressure is reached and thereafter, the slug 14, the slug receiver 12' and the punch 11 are removed from the main pipe rail 1. Therefore, also according to the method, the compressive residual stress can effectively be generated and made to remain at the periphery of the opening end portion of the flow path of the main pipe rail at the branch hole 1-2 similar to the case of the steel ball since the pressing force is applied to the opening end portion of the flow path of the main pipe rail at the branch hole 1-2 by the slug 14 pressed by the punch 11.

Further, it is preferable to use a slug 14' having a constitution illustrated by FIGS. 18(A), 18(B), 18(C) and 18(D) in place of the slug 14 of FIG. 17(B). The slug 14' shown by FIGS. 18(A), 18(B), 18(C) and 18(D) is constituted integrally by a front end portion 14'-1 with a section in a circular shape, a pressing portion 14'-2 with a section in an elliptical shape and a base portion 14'-3 with a section in a rectangular shape. Further, the front end portion 14'-1 with a section in a circular shape is provided with a shape of the section in a circular shape which substantially coincides with the inner diameter of the branch hole 1-2 in order to accurately position the slug 14' by being guided by the branch hole 1-2. Further, the pressing portion with a section in an oval shape is provided with a shape of the section in an oval shape with the longitudinal direction of the flow path 1—1 constituting a long side thereof to be able to press concentratingly both sides in the longitudinal direction of the main pipe rail 1 at the inner peripheral edge portion of the lower end of the branch hole 1-2 where a particularly large tensile stress is liable to generate in the opening end portion of the flow path of the main pipe rail. Further, the base portion 14'-3 with a section in a rectangular shape is provided with a shape of the section in a rectangular shape to ensure the directionality of the slug 14' by being fitted into a rectangular hole 12'-1 provided at the front end portion of the slug receiver 12'.

The operational procedure for effectively generating and making to remain the compressive residual stress at the periphery of the opening end portion of the flow path of the main pipe rail is similar to that of FIG. 17(B) and although an explanation has been given of a common rail having a boss portion of an inside screw type in FIGS. 17(A) and 17(B) and FIG. 18, the present invention can naturally be used similarly in the case of a common rail having a boss portion of an outside screw type.

As described above, according to the present invention, the compressive residual stress is generated at the periphery of the opening end portion of the flow path of the main pipe rail in the branch hole by the press system by using a punch or the like (outer pressure system), the inner pressure system by hydraulic pressure or oil hydraulic pressure, the pipe expanding system and the diameter expanding system by using a spherical body, a plug or the like, or the pressing system by using a spherical body or a slug having a converging front end by which the tensile stress generated at the inner peripheral edge portion P of the lower end of the branch hole caused by high internal pressure of the main pipe rail, can significantly be reduced by a canceling action by the above-described compressive residual stress. Further, when the press system by using a punch or the like is adopted in the means for generating the compressive residual stress at the periphery of the opening end portion of the flow path of the main pipe rail, the inner peripheral face of the flow path of the main pipe rail in the vicinity of the branch hole is slightly projected by a press and the flat portion is formed by which the stress generated at the inner peripheral edge portion P of the lower end of the branch hole can further be reduced by the flattening action and the compressive residual stress.

Further, although in the above-described embodiments, each of the common rails is provided with a structure where the center of the flow path of the main pipe rail coincides with the center of the branch hole of the boss portion, the present invention is naturally applicable to a common rail in which a center of a branch hole of a boss portion is made eccentric in the diameter direction of the flow path of the main pipe rail.

Meanwhile, the branch pipe 2 comprises a furcated branch pipe or a branch metal piece, the inside of which is provided with the flow path 2-1 communicating with the flow path 1—1 of the main pipe rail 1 and the end portion of which is provided with the pressing seat face 2-3 constituted by the connection head portion 2—2 in, for example, a tapering shape. In respect of the connection structure, in the case of a branch pipe connecting structure shown by FIG. 19, the pressing seat face 2-3 constituted by the connection head portion 2—2 on the side of the branch pipe 2 is engageably brought into contact with the pressure receiving seat face 1-4 on the side of the main pipe rail 1 and the fastening box nut 3 previously integrated to the side of the branch pipe via the sleeve washer 4, is screwed to the outside screw 1-5 of the boss portion 1-3 by which the constitution is connected by fastening operation accompanied by pressing the sleeve washer 4 on the connection head portion 2—2 right under thereof.

Figure 20:
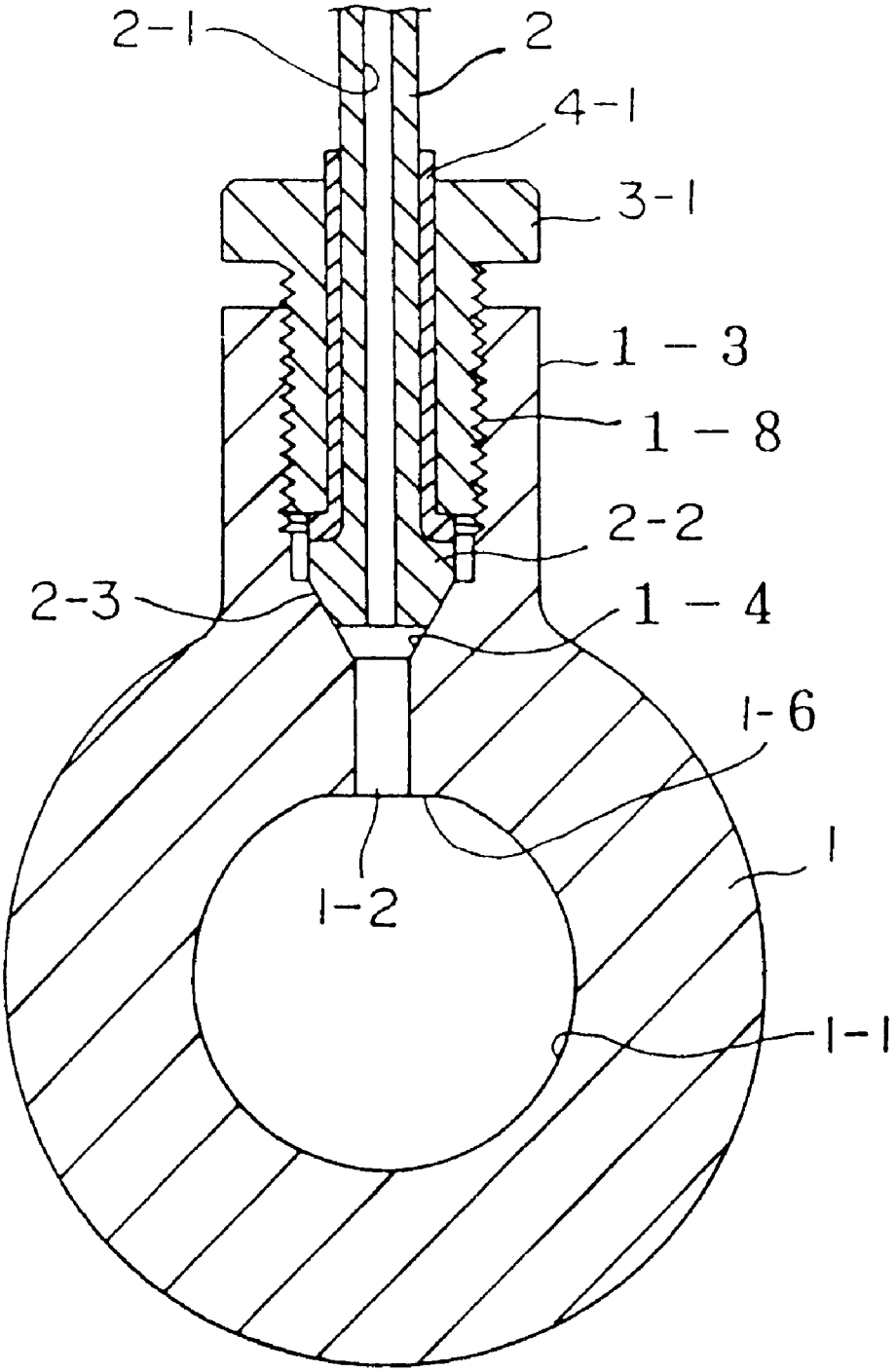
FIG. 20 is a longitudinal sectional view showing an example of a structure of connecting a branch pipe according to a method of fabricating a common rail having boss portions of an inside screw type integrated with a main pipe rail.
Figure 21:
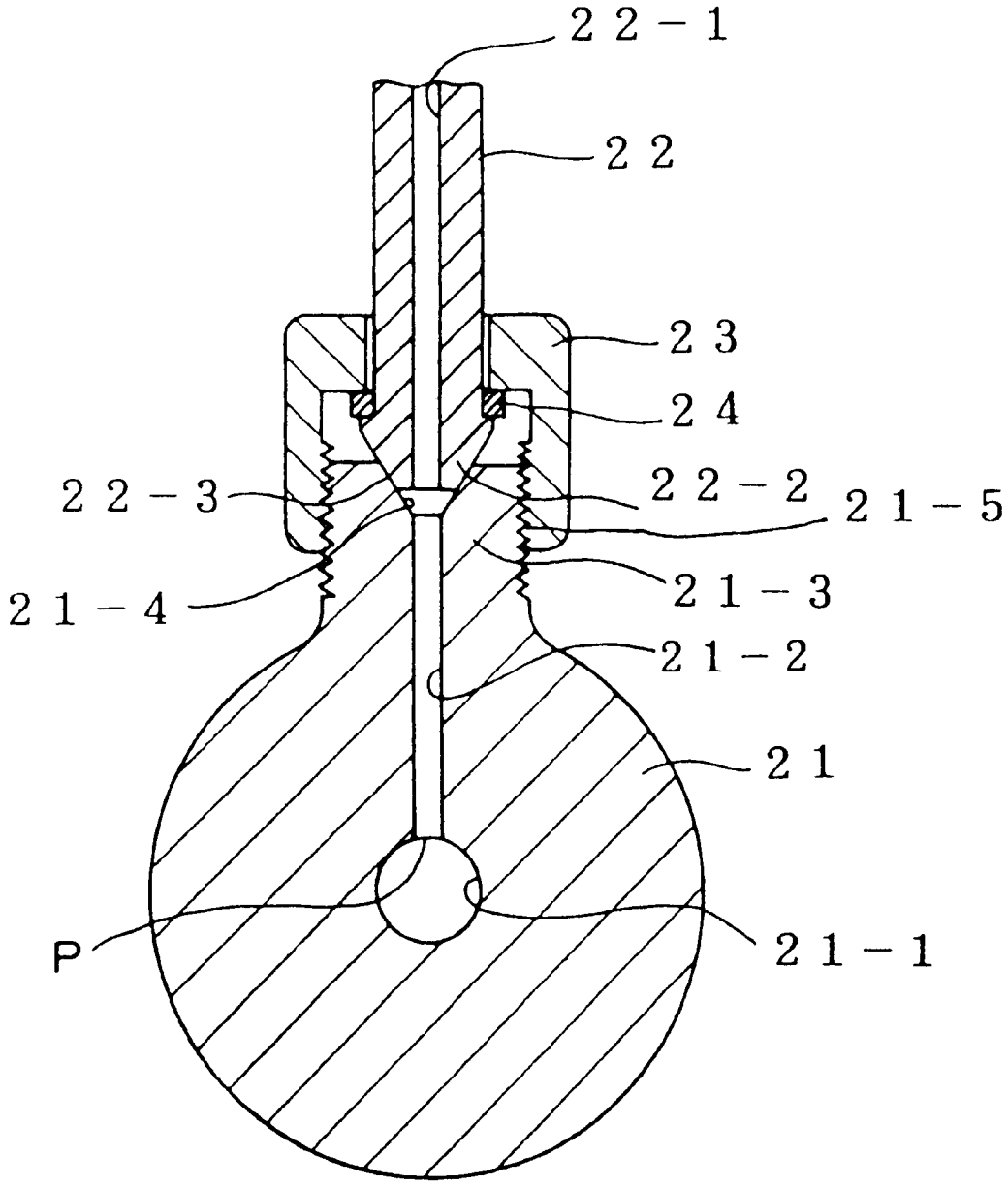
FIG. 21 PRIOR ART
FIG. 21 is a longitudinal sectional view showing a conventional structure of connecting a branch pipe of a common rail having boss portions of an outside screw type which is an object of the present invention.
Figure 22:
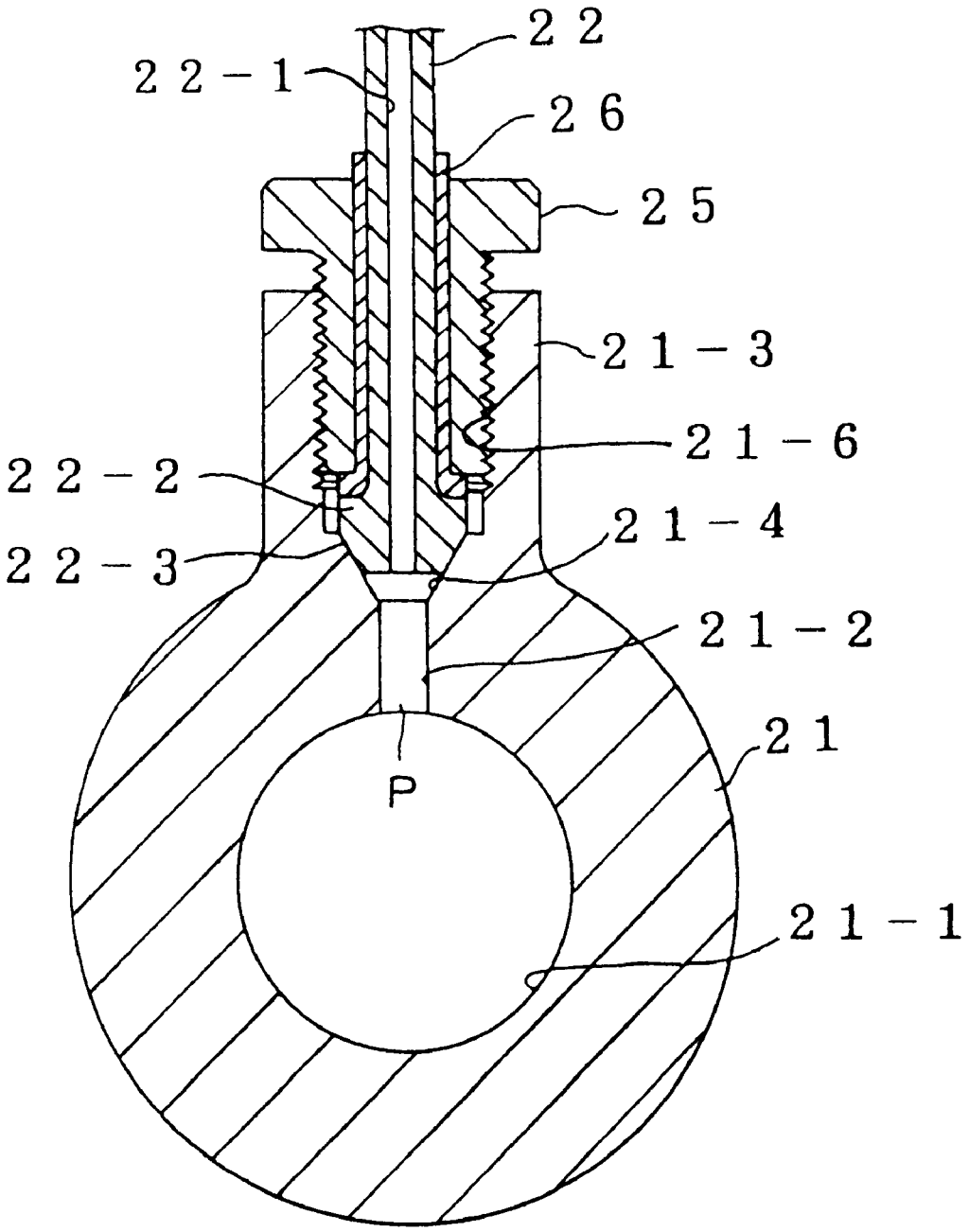
FIG. 22 PRIOR ART
FIG. 22 is a longitudinal sectional view showing a conventional structure of connecting a branch pipe of a common rail having boss portions of an inside screw type which is an object of the present invention.

Further, in the case of the branch pipe connection structure shown by FIG. 20, the pressing seat face 2-3 constituted by the connection head portion 2—2 on the side of the branch pipe 2 is engageably brought into contact with the pressure receiving seat face 1-4 on the side of the main pipe rail 1 and the fastening outside screw nut 3-1 previously integrated to the side of the branch pipe via the sleeve washer 4-1, is screwed to the inside screw 1-8 provided on the inner peripheral face of the bottomed hole 1-2*a*' of the boss portion 1-3 by which the constitution is connected by fastening operation accompanied by pressing the sleeve washer 4-1 on the connection head portion 2—2 right under thereof.

As has been explained above, according to the common rail of the present invention, generation of tensile stress at the inner peripheral edge portion of the lower end of the branch hole can effectively restrained by canceling it by the compressive residual stress and the inner pressure fatigue strength at the branch pipe connecting portion can be promoted and accordingly, there is achieved an excellent effect of being excellent in durability and capable of achieving a firm and stable function by dispensing with leakage of fluid caused by occurrence of cracks. Further, according to the method of fabricating the common rail of the present invention, only the pressure applying step is added to the normal fabrication step and a complicated facility is not needed and accordingly, there is achieved a significant effect in which there is almost no problem of increase in facility cost due to an increase in steps, reduction in productivity and the like and a high quality common rail can be produced inexpensively.

What is claimed is:

1. A common rail comprising:

a main pipe rail having a peripheral wall extending in an axial direction;

a main flow path inside the peripheral wall of the main pipe rail and extending in the axial direction; and at least one boss provided on the peripheral wall of the main pipe rail, said boss including a branch hole communicated with the main flow path and having a pressure receiving seat opened outwardly;

a branch pipe having a branch flow path communicating with the main flow path, said branch pipe including a connection head with a pressing face at an end of the branch pipe;

a fastening nut mounted to the branch pipe and fastened to the boss for urging the pressing face of the branch pipe into contact with the pressure receiving seat of the boss to press portions of the main pipe rail right under the connection head; and wherein the main pipe includes a compressive residual stress at locations in the peripheral wall where the main flow path of the main pipe rail communicates with the branch hole.

2. The common rail according to claim 1, wherein the branch pipe is connected to the main pipe rail by fastening the fastening nut to an outside screw on an outer peripheral face of the boss to press the main pipe rail right under the connection head.

3. The common rail according to claim 1, wherein the branch pipe is connected to the main pipe rail by fastening the fastening male nut to an inside screw on an inner peripheral face of a bottomed hole of the boss to press the main pipe rail right under the connection head.

4. The common rail according to claim 1 wherein a main flow path is substantially cylindrical at locations spaced from the branch hole, and wherein the peripheral wall is flatten along portions of the main flow path surrounding the branch hole, the flatten portion of the peripheral wall comprising the location in the peripheral wall having the compressive residual stress.

* * * * *